US010336071B2

(12) United States Patent
Poulikakos et al.

(10) Patent No.: US 10,336,071 B2
(45) Date of Patent: Jul. 2, 2019

(54) MULTI-NOZZLE PRINT HEAD

(71) Applicant: ETH Zurich, Zurich (CH)

(72) Inventors: Dimos Poulikakos, Zollikon (CH); Julian Schneider, Zurich (CH); Patrick Galliker, Horgen (CH)

(73) Assignee: ETH ZURICH, Zurich (CH)

( * ) Notice: Subject to any disclaimer, the term of this patent is extended or adjusted under 35 U.S.C. 154(b) by 0 days.

(21) Appl. No.: 15/547,322

(22) PCT Filed: Jan. 28, 2016

(86) PCT No.: PCT/EP2016/051800
§ 371 (c)(1),
(2) Date: Jul. 28, 2017

(87) PCT Pub. No.: WO2016/120381
PCT Pub. Date: Aug. 4, 2016

(65) Prior Publication Data

US 2018/0009223 A1 Jan. 11, 2018

(30) Foreign Application Priority Data

Jan. 29, 2015 (EP) ..... 15153061

(51) Int. Cl.
*B41J 2/14* (2006.01)
*B41J 2/06* (2006.01)

(52) U.S. Cl.
CPC ..... *B41J 2/1433* (2013.01); *B41J 2/06* (2013.01); *B41J 2/14088* (2013.01); *B41J 2002/14475* (2013.01)

(58) Field of Classification Search
CPC ..... B41J 2/1433; B41J 2/06; B41J 2/14088; B41J 2002/14475
See application file for complete search history.

(56) References Cited

U.S. PATENT DOCUMENTS 3,949,410 A * 4/1976 Bassous ..... B41J 2/02 347/75
5,278,583 A 1/1994 Oda et al.
7,449,283 B2 11/2008 Nishi et al.
7,665,829 B2 2/2010 Ueno et al.
7,971,962 B2 7/2011 Murata
(Continued)

FOREIGN PATENT DOCUMENTS

EP 1550556 A1 7/2005
EP 1797961 A1 6/2007
(Continued)

*Primary Examiner* — Geoffrey S Mruk
(74) *Attorney, Agent, or Firm* — The Webb Law Firm

(57) ABSTRACT

A print head (1) for depositing a liquid on a substrate comprises a layer structure including a stop layer (5) made of a dielectric material, an electrically conducting device layer (6), and an insulator layer (7) made of a dielectric material. A nozzle (3) is formed in the layer structure. The nozzle has a nozzle opening (34) for ejecting the liquid. A ring trench (31) is formed around the nozzle. The nozzle opening and the ring trench are radially separated by an annular nozzle wall (32). An ejection channel (37) is formed adjacent to the ring trench along the direction of ejection. An extraction electrode (8) is arranged on the insulator layer (7) and surrounds the nozzle.

31 Claims, 5 Drawing Sheets

(56) References Cited

U.S. PATENT DOCUMENTS

| | | | | |
|---|---|---|---|---|
| 8,898,902 | B2 * | 12/2014 | Hong | B41J 2/06 29/890.1 |
| 2006/0243381 | A1 * | 11/2006 | Ito | B41J 2/1433 156/275.5 |
| 2007/0040870 | A1 | 2/2007 | Lu et al. | |
| 2007/0126799 | A1 | 6/2007 | Steiner | |
| 2011/0187798 | A1 | 8/2011 | Rogers et al. | |
| 2014/0205761 | A1 | 7/2014 | Galliker et al. | |

FOREIGN PATENT DOCUMENTS

| | | | |
|---|---|---|---|
| EP | 1844935 | A1 | 10/2007 |
| EP | 2567819 | A2 | 3/2013 |
| WO | 2007064577 | A1 | 6/2007 |
| WO | 2013000558 | A1 | 1/2013 |

* cited by examiner

MULTI-NOZZLE PRINT HEAD

CROSS-REFERENCE TO RELATED APPLICATIONS

This application is the U.S. national phase of International Application No. PCT/EP2016/051800 filed Jan. 28, 2016, and claims priority to European Patent Application No. 15153061.5 filed Jan. 29, 2015, the disclosures of which are hereby incorporated in their entirety by reference.

BACKGROUND OF THE INVENTION

Field of Invention

The present invention relates to a system and a method for electrohydrodynamic printing of liquid on a substrate.

Description of Related Art

The use of ink jet printers for printing information on a medium is well established. Common techniques comprise printers that emit a continuous stream of fluid drops, as well as printers that emit drops only when the corresponding command for emitting is received, respectively. The former group of printers is generally known as continuous ink-jet printers, and the latter as drop-on-demand ink-jet printers, respectively.

In continuous ink-jet printing a high-pressure pump directs liquid ink from a reservoir to microscopic nozzles, thereby creating a continuous stream of ink droplets. The ink droplets are then subjected to an electrostatic field in order to get charged. The charged droplets then pass through a deflecting field such as to be either printed on the substrate or to continue undeflected and being collected in a gutter for re-use.

In drop-on-demand printing, liquid ink is transferred from a reservoir, such as a nozzle, to a substrate by applying a pressure to the reservoir. Ejection of droplets is commonly performed by ways of pressurizing the liquid ink contained inside the nozzle to a degree that allows overcoming of the surface tension and of the viscosity of the liquid. Additionally, the applied pressure has to be sufficiently large in order to accelerate ejected droplets to a velocity that allows precise deposition of these droplets on the substrate. Each time the pressurizing element is triggered, one droplet of a defined volume is ejected, i.e., the printing occurs according to an all-or-none fashion.

Continuous ink-jet printing methods provide a faster throughput than the drop-on-demand methods. The resolution, however, is generally better for the drop-on-demand techniques. Furthermore, continuous ink-jet printing suffers from higher ink losses.

Some of the major problems related to the drop-on-demand and to the continuous ink-jet printing methods are the high pressures required for the ejection of small droplets (where small refers to a size below a few tens of micrometers) and the difficulty of depositing these small droplets with high accuracy, respectively. Droplets being smaller than 10 micrometers are easily decelerated and deflected by their gaseous environment. Furthermore, the droplets ejected by liquid pressurization are generally equally large or even larger than the nozzle they are ejected from. Therefore, in order to obtain small droplets, small nozzles are required which however, suffer from the well-known problem of getting clogged easily.

Electrohydrodynamic jet printers differ from ink-jet printers in that they use electric fields to create fluid flows for delivering ink to a substrate. Especially, electrohydrodynamic printing enables the printing of droplets at much higher resolution than compared to ink-jet printing. While conventional ink-jet printing employs internal pressure pulses to push liquid out of a nozzle, electrohydrodynamic printing methods make use of the fact that liquid can be electrically charged and be pulled out of a nozzle by the force established between the charged liquid and the electric field that is applied in the region of the nozzle.

WO 2007/064577 A1 discloses a common stimulation electrode, which, in response to an electrical signal, synchronously stimulates all members of a group of fluid jets emitted from corresponding nozzle channels to form a corresponding plurality of continuous streams of drops.

A method for manufacturing a collective transfer ink-jet nozzle plate is disclosed in EP 1844 935 B1, where a three-dimensional structure is arranged on a substrate according to a micro ink-jet printing method which is then covered with a curing material. After curing, micro nozzle holes are formed in the plate of the curing material.

EP 1 550 556 A1 discloses a method for producing an electrostatic liquid jetting head comprising a nozzle plate and a driving method for driving the electrostatic liquid jetting head. When a voltage is applied to a plurality of jetting electrodes arranged on a base plate, droplets are ejected from a plurality of nozzles that are arranged on the electrostatic liquid jetting head.

High-resolution electrohydrodynamic ink-jet printing systems and related methods for printing functional materials on a substrate surface are disclosed in US 2011/0187798, where, e.g., a nozzle is electrically connected to a voltage source that applies an electric charge to the fluid in the nozzle to controllably deposit the printing fluid on the surface, and wherein the nozzle has a small ejection orifice such that nanofeatures or microfeatures can be printed.

A method for the production of 1D, 2D and/or 3D depositions from a liquid loaded with nanoparticles or other solid-phase nano-compounds is disclosed in WO 2013/00558, where a nozzle-ended container holds the liquid, an electrode is in contact with the liquid at the nozzle or in the container, and where a counter electrode is located in and/or on and/or below and/or above a substrate onto which the depositions are to be produced.

Many different ways of droplet ejection are possible in electrohydrodynamic printing, the most common one being cone-jet printing, in which a thin jet is ejected from a much larger nozzle (i.e. a jet with smaller radius compared to the radius of the corresponding nozzle). Electrohydrodynamic liquid ejection has been extensively used in the area of electrospraying and electrospinning, but only recently it has found application in controlled printing. Current applications generally suffer from problems related to the strongly charged nature of the ejected liquid. This often results in repulsion of ejected droplets and as a consequence to variations in their positions of impact on the substrate. Repulsion may either occur between two airborne droplets or between airborne droplets and the charge associated with droplets that are already deposited on the substrate.

Furthermore, very high voltages are often required for causing the ejection of liquid. One of the main issues related to electrohydrodynamic liquid ejection is its requirement for very high electrical fields, which are higher than the dielectric breakdown strength of air.

This issue is generally solved by using sharp nozzles and curved counter electrodes (e.g. ring electrodes) that focus the electric field. However, the electrical fields established between the nozzles and the counter electrodes usually decrease with increasing distance between the nozzles and the counter electrode. The average electric fields established between the nozzles and the counter electrodes are therefore low enough in order to not cause electrical breakdown. However, once a charged droplet is ejected, it has to be accelerated towards the substrate, especially if the droplet is smaller than 10 μm or even smaller than 1 μm, i.e., if the droplet experiences a gravitational acceleration which is negligible. Since electrohydrodynamic printing can generate droplets with diameters being smaller than 100 nm, strong accelerating electric fields are therefore crucial for an accurate placement of the droplets.

Especially the deposition of droplets on dielectric substrates can result in substantial spraying deflection of the approaching charged droplets due to the residual charge of prior droplets already deposited on the substrate. This effect becomes more problematic if the accelerating electric field strengths decrease towards the substrate. In this case, the electric field originating from the charge of already deposited droplets will be stronger than the accelerating fields which might result in repulsion of incoming droplets on the substrate that are equally charged as the already deposited droplets. Of course, repulsion can also take place between airborne droplets if the accelerating fields are not set to compensate the deflection resulting from residual electrical charge on the airborne droplets.

Electrical crosstalk may result from the interaction between closely arranged nozzles and the droplets ejected from these nozzles. A close arrangement and the parallel operation of a multitude of electrohydrodynamic nozzles are also hindered by the fact that these nozzles would have to be operated with very high voltages that are difficult to control.

NanoDrip printing, i.e., the printing of nanoscale droplets, allows a printing resolution of better than 100 nm. If, however, a large area shall be printed at such a high resolution within a reasonable time, the print head would have to be scanned with a velocity in the range of tens of millimeters per second or even meters per second, and the nanoscale droplets could no longer be deposited on the substrate with sufficient accuracy. In addition, in order to deposit droplets within a spacing of about 100 nm at a scan velocity of one meter per second, the droplet ejection would require an ejection frequency of around 10 MHz.

Because the droplets are small in NanoDrip printing, these droplets only cover a very small area on the substrate they are printed on. In order to print a large area on a substrate at industrially relevant throughput, a multitude of densely arranged nozzles is needed compared to ink-jet printing or electrohydrodynamic printing performed at a low resolution, while at the same time cross-talk between such densely arranged nozzles and between the droplets they eject, must be prevented, such that nozzles can be individually addressed and droplets be deposited on a substrate with high accuracy.

SUMMARY OF THE INVENTION

It is an object of the present invention to provide a printing system that enables high-resolution printing based on electrohydrodynamic effects from a print head that comprises densely arranged nozzles.

In particular, the invention provides a print head for depositing a liquid on a substrate. The print head comprises a layer structure preferably including, in this sequence along a direction of ejection, the following layers: a stop layer made of a dielectric material; a device layer (also referred to as device electrode) deposited on the stop layer, wherein the device layer preferably is electrically conducting; a first insulator layer being made of a dielectric material and being deposited on the device layer. Further layers may be present between these layers. At least one first nozzle is formed in the layer structure. The first nozzle has a nozzle opening for ejecting the liquid, which extends through the layer structure. A ring trench (a generally annular recess that is open in the direction of ejection) is formed around the first nozzle, radially surrounding the first nozzle. The ring trench extends through the device layer preferably all the way to the stop layer. It is possible that the ring trench extends into the device layer not all the way, but only partially to the stop layer. The nozzle opening and the ring trench are radially separated by an annular nozzle wall that has a distal end surface. An ejection channel is adjacent to the ring trench in the direction of ejection, i.e. the ring trench opens out into the ejection channel in the direction of ejection. Also the nozzle opening opens out into the ejection channel. The ejection channel is preferably a generally cylindrical recess that is open in the direction of ejection. The ejection channel extends partially or fully through the first insulator layer. The ejection channel is centered around the first nozzle and preferably extends through the first insulator layer all the way to the distal end surface of the nozzle. A first extraction electrode is arranged on the first insulator layer and surrounds the first nozzle.

Such a print head can be manufactured in a simple way by using the common methods of microfabrication known from the semiconductor-technology. A print head comprising a very high density of closely spaced, microscopic nozzles can thus be obtained, which allows a precise control over the droplet ejection process such that droplets in the nanoscale range can be accurately deposited on the substrate even from a very large distance.

The annular nozzle wall has an outer circumferential surface defining a nozzle diameter. Half of said nozzle diameter defines a nozzle radius. The ring trench can advantageously have a width between half the nozzle radius and ten times the nozzle radius, preferably between one time the nozzle radius and four times the nozzle radius. In absolute numbers, the ring trench can advantageously have a width between 500 nanometers and 100 micrometers, preferably between 1 micrometer and 20 micrometers, more preferably between 1 micrometer and 10 micrometers. The annular nozzle wall can advantageously have a thickness between 100 nanometers and 10 micrometers, preferably between 200 nanometers and 2 micrometers. The total diameter of the nozzle preferably is between 500 nanometers and 50 micrometers, more preferably between 1 micrometer and 20 micrometers, most preferably between 1 micrometer and 10 micrometers.

The first extraction electrode preferably has an annular portion that radially surrounds the ring trench and defines an electrode width, wherein said electrode width can be between half the nozzle radius and ten times the nozzle radius of the first nozzle, preferably between one times of said nozzle radius and four times of said nozzle radius. Said annular portion can be immediately adjacent to the ring trench it radially surrounds or it can be radially spaced from the ring trench. In general terms, the annular portion of the extraction electrode can form a ring electrode.

At least one conductive path can be attached to the first extraction electrode for electrically contacting said first extraction electrode. The conductive paths connected to any two electrodes on the print head may carry different voltage signals (i.e. amplitude, waveform, polarity etc.) in which case the electrodes and the conductive paths carrying unequal voltage signals should be electrically insulated from each other by providing sufficient lateral spacing in between them such that there is no risk of signal crosstalk (e.g. by electrical breakdown). The conductive path preferably has a width that is smaller than the electrode width of the first extraction electrode it is attached to, at least in proximity to the first extraction electrode. Preferably, opposite to the at least one conductive path, another conductive path is attached to said first extraction electrode in order to create symmetry in the electric fields created at the nozzle.

At least one further nozzle can be formed in the layer structure. The further nozzle can have a larger diameter than the first nozzle. The first nozzle diameter and the further nozzle diameter can differ by a factor that is larger than 1, but preferably below 15.

The layer structure can include at least one further insulator layer which is arranged on the first insulator layer along the direction of ejection. The at least one further insulator layer preferably forms an opening at the position of the at least one first nozzle and/or the at least one further nozzle, and the opening preferably extends the ejection channel.

The first insulator layer can have a thickness between 100 nanometers and 50 micrometers, preferably between 500 nanometers and 5 micrometers.

The print head can comprise a further extraction electrode that is arranged on the further insulator layer or on the first insulator layer, the further extraction electrode preferably surrounding the further nozzle.

The further nozzle can comprise, as in the of case the first nozzle, a further nozzle opening for ejecting the liquid, the further nozzle opening extending through the layer structure. Preferably a further ring trench radially surrounds the further nozzle. Said further ring trench can extend through the first and/or the further insulator layer. The further ring trench extends into the device layer preferably all the way to the stop layer. The nozzle opening of the further nozzle and the further ring trench can be separated by a further annular nozzle wall having a distal end surface, and a further ejection channel can be adjacent to the further ring trench in the direction of ejection, i.e. the further ring trench opens out into the further ejection channel in the direction of ejection. Also the further nozzle opening opens out into the further ejection channel. The further ejection channel extends partially or fully through the first insulator layer and/or the further insulator layer. It is centered around the further nozzle and extends through the first insulator layer and/or through the further insulator layer all the way to the distal end surface of the further nozzle.

The total thickness of the first insulator layer and all further insulator layers arranged between the device layer and a given further extraction electrode preferably is between half of the radius of the further nozzle and ten times the radius of the further nozzle, more preferably between one times said nozzle radius and four times said nozzle radius.

It is to be understood that several further insulator layers can be arranged on the print head, and several further extraction electrodes, preferably each surrounding a particular nozzle, can be arranged on these further insulator layers, too, wherein additional further insulator layers can be introduced in order to achieve a certain separation between a given further extraction electrode and the nozzle.

At least one homogenization electrode can be arranged on at least one of the further insulator layers. Said at least one further insulator layer is preferably arranged on the first extraction electrode or on the further extraction electrode along the direction of ejection. The at least one homogenization electrode preferably surrounds the first nozzle and/or the further nozzle, respectively, as a ring electrode having an inner diameter being equal to or larger than the diameter of the ejection channel, more preferably, it has an inner diameter being equal to or larger than the inner diameter of the first extraction electrode or the further extraction electrode, respectively. Said at least one homogenization electrode can serve the purpose of minimizing axial electrical field inhomogeneities.

The layer structure can include a terminal insulator layer which is arranged either on the first insulator layer or on that further insulator layer that is arranged at a furthest distance from the stop layer along the direction of ejection. Said terminal insulator layer preferably forms an opening that extends the ejection channel along the direction of ejection.

It is to be understood that the terminal insulator layer can correspond to the last insulator layer arranged on the print head along the direction of ejection, i.e., that no additional insulator layers are arranged on said terminal insulator layer.

A shielding layer (also referred to as shielding electrode) can be arranged on the terminal insulator layer, said shielding layer being electrically conductive and being preferably formed as a continuous layer, wherein the shielding layer may have circular openings adjacent to the ejection channels, which can be smaller in diameter than the outer diameter of the respective annular portions of the first extraction electrodes and/or the further extraction electrodes, and wherein the shielding layer radially extends at least beyond the first extraction electrodes and/or the further extraction electrodes.

The shielding layer can serve the purpose of decreasing axial electric field gradients along the preferred flight trajectory of a droplet and of shielding a nozzle from other sources of electric fields, like the extraction electrodes of other nozzles, by covering said sources by a field-impermeable layer. The terminal insulator layer preferably has a thickness between 100 nanometer and 10 micrometer, more preferably between 500 nanometer and 3 micrometer.

The first extraction electrode and/or the further extraction electrode and/or the homogenization electrode can be extended by an electrode extension, wherein the electrode extension is preferably formed as a straight line. The electrode extension can have a length between 1 micrometer and 1 millimeter, preferably between 2 micrometer and 100 micrometer. The electrode extension preferably has a width that is equal to or smaller than the electrode width of said first extraction electrode and/or said further extraction electrode and/or said homogenization electrode, respectively. A conductive path supplying a voltage signal can be arranged on the further insulator layer that is deposited on the electrode extension. The conductive path can be capacitively coupled to the electrode extension and preferably has a radial distance from the nozzle opening that is larger than the distance from the outer circumference of the annular portion of the first extraction electrode and/or of said further extraction electrode and/or of said homogenization electrode, respectively. to said nozzle opening. The width of the at least one conductive path preferably is wider than the width of the electrode extension, so as to improve capacitive coupling between the electrode extension and the conductive path.

An etch-stop layer can be arranged on the distal end surface of the first nozzle and/or the further nozzle and preferably also between the device layer and the first insulator layer. Said etch-stop layer comprises an etch-resistant and preferably dielectric material. In the alternative or additionally, a device coating can be arranged between the device layer and the first insulator layer, said device layer comprising a conductive material, preferably a metal. A contact angle discontinuity in the form of a sharp transition can be formed in the etch-stop layer or in the device coating in the region of the ring trenches to circumvent wetting of the ring trench by the liquid.

The first extraction electrode can be split into at least two portions, preferably into at least three portions. For example, an annular extraction electrode, i.e., a ring electrode, can be split into at least two segments of equal semiannular shape that are uniformly arranged around a particular nozzle and that enclose a lateral separation between their opposite ends.

At least one liquid supply layer can be arranged below the stop layer, the liquid supply layer forming one or more liquid supply reservoirs and/or one or more liquid supply channels that are in fluid communication with the nozzle opening. The depth of a liquid supply reservoir preferably is smaller than 50 times its width, more preferably smaller than 30 times its width.

At least part of the surface of the print head can be coated with a protective coating. The protective coating is preferably made of a dielectric material and prevents a dielectric breakdown through a surrounding gaseous environment, e.g. it blocks electricity from breaking through the air. Preferably, the protective coating is applied after formation of the electrodes.

At least part of the surface of the print head can be coated with a surface coating. Preferably, it is at least coated on all surfaces beyond the nozzle opening on the side of the print head that faces the substrate. The surface coating preferably is liquid-repellent and preferably comprises a polymeric material and/or organic material, more preferably comprises polytetrafluoroethylene. Coating at least part of the surfaces of the print head with such a liquid-repellent material may help preventing that liquid is drawn into the ring trench.

An electrohydrodynamic printing system comprising a print head as described above preferably comprises an acceleration electrode, wherein the acceleration electrode is spaced from the print head along the direction of ejection. A substrate can be placed between print head and acceleration electrode, preferably it is immobilized on the acceleration electrode. The distance between the print head and the substrate is between 50 micrometers and 5 millimeters, preferably between 100 micrometers and 1 millimeter. In relative terms, it is preferably at least ten times the diameter of the largest nozzle arranged on the print head.

A method of electrohydrodynamic printing of a liquid onto a substrate using the above described electrohydrodynamic printing system comprises, in arbitrary order: i) supplying the liquid to the nozzle opening, wherein the supplied liquid preferably is at electrical ground; ii) optionally applying a device potential to the device layer for shaping the electric field at the nozzle and/or for forming a convex meniscus of a liquid surface in the region of the nozzle opening, wherein the difference between the device potential and a potential of the liquid is zero or lower than a minimal voltage necessary for ejection of a droplet; iii) applying an extraction potential to at least one of the extraction electrodes, wherein the difference between the applied extraction potential and the potential of the liquid is equal to or above the minimal voltage necessary for ejection of a droplet from said convex meniscus; iv) optionally applying a homogenization potential to the homogenization electrode such that the ejected droplet experiences less lateral deflection in the ejection channel; v) optionally applying a shielding potential to the shielding electrode such that the ejected droplet experiences less lateral deflection in the ejection channel and in the region outside of the ejection channel; and vi) applying an acceleration potential to the acceleration electrode such that the ejected droplet is accelerated towards the substrate without being laterally deflected. One or more of the preceding steps can be carried out simultaneously.

The difference between e.g. the device potential and the potential of the liquid, or between the first extraction potential and the potential of the liquid, respectively, can also be termed a voltage applied between two electrodes. Preferably, the ejection of a number of droplets is not caused by introducing regular intervals of at least part of this sequence with the goal of ejecting one single droplet per interval, but instead by keeping all potentials activated (as continuous DC or AC voltages) until a desired amount of liquid has been deposited, and wherein a natural frequency of ejection will depend particularly on the applied electric potentials. The method of electrohydrodynamic printing can involve other sequences of the steps i)-iv) and/or other potentials applied to the respective electrodes, respectively. Furthermore, some steps may be executed in parallel. For example, a voltage can constantly be applied to the device electrode, the homogenization electrode, the shielding electrode and the acceleration electrode, respectively. Or, the device layer can be kept at the same potential as the liquid such that the formation of the meniscus and the ejection of a droplet happen simultaneously by the action of the extraction electrode. It is preferred, however, that no other electrodes than the extraction electrodes cause the ejection of droplets.

The absolute value of the applied device potential relative to the potential of the liquid can have a different polarity than the applied extraction potential relative to the potential of the supplied liquid during ejection of a droplet.

The shielding potential applied to the shielding layer, relative to the liquid potential, can have a smaller amplitude than the extraction potential applied to the extraction electrodes, relative to the liquid potential, and the homogenization potential applied to the homogenization electrode, relative to the liquid potential, can have a smaller amplitude than the extraction potential applied to the extraction electrodes, relative to the liquid potential, during the ejection of a droplet.

A volumetric rate associated with the ejection of the droplet can be adjusted by a fluid supply unit.

The potentials of the acceleration electrode, the shielding electrode and the homogenization electrode relative to the potential of the liquid can have a polarity that is of the same polarity as the applied extraction potential relative to the liquid potential during the ejection of a droplet. Here term "absolute" is to be understood as the amplitude of the voltage that is applied between two electrodes.

It is preferred that the potential differences of the shielding electrode and the homogenization electrode relative to the liquid potential are lower than the voltage applied to the extraction electrode relative to the liquid potential during droplet ejection. It is preferred, however, that the voltage applied to the acceleration electrode relative to the liquid potential is higher than the voltage applied to the extraction electrode relative to the liquid potential.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF THE INVENTION

Figure 1:
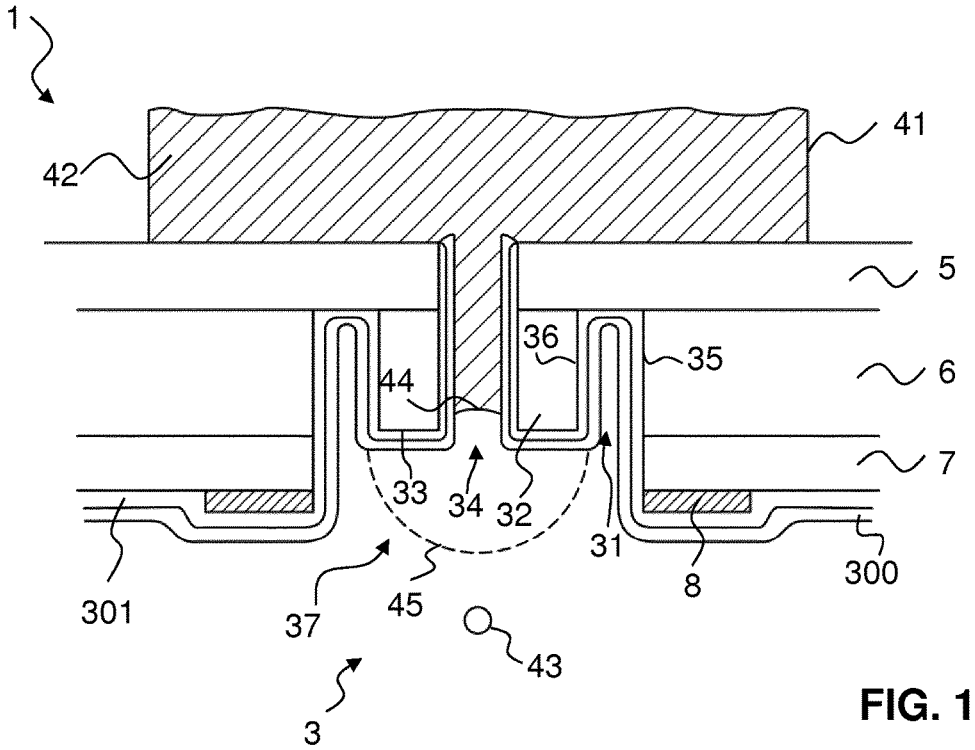
FIG. 1 shows a sectional drawing of a print head for depositing liquid from a liquid supply reservoir on a substrate comprising a first nozzle according to a first embodiment.

First, a few general considerations on the electrohydrodynamic printing system will be given. The description of the preferred embodiments is provided at the end of these considerations.

A print head according to the present invention may comprise hundreds, thousands or even millions of nozzles. The nozzles can be formed from silicon wafers, preferably from SOI (silicon on insulator) wafers by common microfabrication methods that are well known to those skilled in the art. The wafer essentially limits the lateral width of the print head and defines the area that can be covered by the nozzles. A wafer may also contain several smaller print heads that can be cut from said wafer. The wafer preferably has a length and a width of around 200 mm The thickness of the print head is mainly defined by the thickness of the liquid supply layer and any additional layers that may be added to this layer. Preferably, the accumulated thickness of all of these layers will not exceed a few millimeters.

Typical substrates comprise sheets, pieces or other, preferably flat geometries of glasses, polymers, papers, metals, semiconductors, ceramics, composite or biological materials. Especially when using polymers, papers or other flexible materials, the substrate may be a foil that originates from a roll that is at least partially de-rolled such as to allow the de-rolled foil or parts of it to be placed in between print head and acceleration electrode. The substrate may further comprise layers or general arrangements of other materials, e.g. functional structures that can be used, e.g., for displays, solar cells or sensors, logic elements or touchscreens. The main purpose of the print head is to form highly-resolved functional structures from inks that contain dielectric, semiconducting, metallic or biological materials, wherein such structures can perform an individual functionality or they can complement functional structures that are already contained on a substrate in order to create a higher order functionality. In this sense, the print head may be employed for additively creating at least partial functionality of, e.g. displays, solar cells, sensors, logic circuits, batteries or touchscreens. More precisely, the print head may be employed, for example, for creating ultra-fine conductive tracks that may collectively be employed as transparent metal mesh conductors, e.g. in applications such as touchscreen sensors, displays, solar cells, transparent thermal heaters, smart windows and antistatic or electric shielding layers. The print head may also be employed for creating fully passive elements, such as topographic masks (including 3D masks) that can be used for imprint lithography or the like. The print head may also be employed for creating passive optic elements such as plasmonic entities that may be employed in security applications or the like. The print head may also be used for prototyping applications, e.g. as an alternative to e-beam lithography, wherein materials can be additively added to a substrate. Such materials can also be used in connection to subtractive processing, e.g. as etching masks. The print head may also be employed for ejecting certain solvents or liquid chemicals that can be employed for structured etching of a certain material, i.e. by locally removing said material from a layer by the employed solvent or chemical.

The nozzles and the device layer are preferably made from the same material and preferably have a common thickness. Most preferably they are made from silicon having a thickness below 50 μm, preferably between 1 μm and 10 μm. The nozzles and the device layer may also comprise other materials than silicon. However, preferably the device layer consists of a material that is not exclusively consisting of an electric insulator such that an electric potential can be applied to it. The nozzle may comprise solid materials including electric insulators and is most preferably made of the same material as the device layer.

The silicon layer that may be used to form the nozzles and the device layer is preferably arranged on top of the stop layer, which has the purpose of selectively resisting the etch process that can be applied in order to form the nozzles. Etching is often used in microfabrication in order to chemically or physically remove material from one or more layers of a wafer during manufacturing. For many etch steps, part of the wafer is protected from the etchant by a masking material which resists etching and the etching process can be controllably stopped at an etch-resistant layer. In the context of the present invention, the stop layer is used as an etch stop at the location where the ring trenches are to be created and it preferably has a thickness between 10 nm and 5 μm, more preferably between 100 nm and 1 μm. The stop layer may comprise dielectric materials such as $SiO_2$ or $Al_2O_3$ which possess a high etch resistance.

The ring trenches are preferably formed in an anisotropic dry etching process of silicon, e.g., according to a hydrogen bromide (HBr) or sulfurhexafluoride ($SF_6$) based dry-etching process, such as to obtain side walls which form an angle of approximately 90°.

The liquid supply layer is preferably made of silicon but may also comprise transparent materials like $SiO_2$. The liquid supply layer preferably has a thickness between 200

μm and 1 mm and has the additional purpose of providing mechanical strength to the print head.

The liquid preferably comprises a solvent and non-volatile material, which is left behind on the substrate after evaporation of the solvent in the deposition process. The solvent preferably is selected from the group of water, organic solvent, or a mixture thereof, the organic solvent preferably being selected from the group of saturated carbohydrate solvents or aliphatic alcoholic solvents. The nano-sized solid material preferably comprises at least one species selected from the group of preferably nanoparticles which are metal based nanoparticles, most preferably gold nanoparticles, but can also be any kind of metal oxide, semiconducting or other inorganic solid and/or magnetic nanoparticles, conductive carbon-based materials, such as, e.g., fullerenes, carbon-nanotubes or graphene, biological materials like enzymes, DNA or RNA, or other molecules which are not prone to vaporization, e.g., conducting or nonconducting polymers for the stabilized dispersion in a liquid solvent, salts or single molecules. Liquid may also be deposited without the addition of non-volatile material, e.g. when attempting to etch a material that is contained on the substrate.

The liquid inside the liquid supply reservoir preferably is at electrical ground. Said ground can be globally applied to the bulk material of the liquid supply layer that is in contact with the liquid contained in the liquid supply reservoir. To allow proper functionality the interior surface of the annular nozzle wall and the surface of the liquid supply reservoir may be wettable by the ink employed. Wettable in this context means that the liquid encloses a contact angle with these surfaces that is less than 90°. If the surfaces are wettable, liquid can be drawn from the liquid supply reservoir into the nozzle opening simply by capillary forces.

If wetting does not take place spontaneously, one may apply an electric potential, the device potential, to the device layer which differs from the electrical ground. This may result in an electrohydrodynamic force experienced by the grounded liquid which then guides the liquid through the nozzles into the region of the nozzle openings, where it attains an idle meniscus.

The insulator layers deposited on the device layer serve as insulation layers between the device layer (including the terminal insulator layer and those further insulator layer to be introduced later) and the plurality of extraction electrodes arranged on the insulator layers but in general they act as insulator layers between any two axially separated conductive elements that eventually have to form a voltage between them. The insulator layers preferably comprise a dielectric material, such as $Si_3N_4$, $SiO_2$, $Al_2O_3$, silicon oxynitride or the like, preferably a dielectric material of a low-stress nature. Especially for thick insulator layers the material to be used may also comprise spin-on or dry-film resistant materials like SU-8 or the like. Every individual insulator layer should be chosen sufficiently thick in order to prevent an electrical breakdown that might be caused by a too high electric potential difference established between any conductive element and the device electrode or between any two conductive elements that are arranged on two different insulator layers.

The annular nozzle walls preferably have a thickness between 100 nm and 10 μm, more preferably between 200 nm and 2 μm. The total diameter of the nozzle preferably is between 500 nm and 50 μm, more preferably between 1 μm and 20 μm, most preferably between 1 μm and 10 μm and it preferably is at least five times larger than the size of the droplets intended to eject.

Annular first extraction electrodes can be arranged on the first insulator layer and may extend from the edge of the ejection channel outwardly, i.e., surrounding thereby the ejection channel of any first nozzle in a circumferential direction. The inner diameter of the annular first extraction electrode may also be larger than the diameter of the ejection channel.

At least one further nozzle can be formed in the layer structure. The further nozzle can have a larger diameter than the first nozzle. The first nozzle diameter and the further nozzle diameter can differ by a factor that is preferably below 15.

The layer structure can include at least one further insulator layer which is arranged on the first insulator layer along the direction of ejection. An ejection channel is centered around every further nozzle and extends all the way to the distal end surface of said further nozzles. The ejection channels already formed in the first insulator layer are extended into the at least one further insulator layer all the way through the at least one further insulator layer.

The print head can comprise a further extraction electrode that is arranged on a further insulator layer and which surrounds the further nozzle. The further nozzle can comprise, as can the first nozzle, a nozzle opening for ejecting the liquid and can extend from the insulator layer preferably all the way to the stop layer. A ring trench can also be formed in the insulator layer that radially surrounds the further extraction electrode.

It is to be understood that several further insulator layers can be arranged on the print head, and several further extraction electrodes, preferably each surrounding a particular further nozzle, can be arranged on these further insulator layers, too, wherein additional further insulator layers can be introduced in order to achieve a certain separation between a given further extraction electrode and the nozzle.

Once the idle meniscus at the liquid surface in the region of the nozzle opening has been formed, the actual electrohydrodynamic ejection process may be initiated. Essentially, ejection at a given nozzle can be initiated by applying an electric field at the region of said nozzle. The creation of this electric field is described in more detail below, but preferably it results from the creation of an applied electric potential difference between the preferably grounded liquid and the extraction electrode associated with said nozzle.

In a first step, the electric field then results in charging of the liquid surface at the idle meniscus. The interaction between the charged liquid meniscus and the electric field leads to a force that pulls the idle meniscus out of the nozzle opening and changes its appearance from a concave meniscus shape towards a convex meniscus shape. Generally, the radius of the meniscus will increase during this transformation, because the wetting front of the convex meniscus will generally pin at the outer nozzle wall while the wetting front of the idle meniscus is pinned at the inner nozzle wall of the nozzle.

The ejection of droplets can be caused if the electric field at the convex meniscus is further intensified by increasing the potential difference between extraction electrode and liquid until the electrically induced stress at the convex meniscus surface overcomes the surface tension of the liquid. With gravitational forces being negligible, as it is most often the case in the context of the present invention (due to the small scales), no droplet ejection is expected to take place without this further intensification of the electric field. At the minimal ejection conditions, i.e., after application of the lowest possible potential difference between extraction electrode and liquid that will cause droplet ejection, the diameter of the ejected droplets is approximately the same as the diameter of the convex meniscus. A further increase of the extraction potential causes the ejection of droplets having a smaller diameter than that of the convex meniscus. The ejected droplets are highly charged, either positively or negatively, depending on the polarity of the potential of the extraction electrode relative to the liquid potential.

While the device electrode may serve as a common electrode for a plurality of nozzles arranged on the print head and is preferably turned on at any point in time during the printing process, it is generally not causing the ejection of liquid droplets. The actual triggering of droplet ejection is preferably caused by the extraction potential applied to the extraction electrodes during the printing process. However, the device electrode may be employed to support droplet ejection, for example by causing an electric field at a nozzle that can cause the generation of a convex meniscus before activation of the extraction electrode. Hence, the minimal ejection voltage of the extraction electrode that is required for droplet ejection is reduced in amplitude.

In contrast to the global nature of the device electrode, a particular extraction electrode can be selectively turned on or off, depending on whether droplet ejection is intended or not. This switched-on/-off state can be different for any individual extraction electrode of the plurality of extraction electrodes at a given point in time. The extraction electrode preferably comprises a metallic conductor, most preferably a noble metal such as gold or platinum. The extraction electrode may also comprise conductors that are optically transparent, for example indium tin oxide (ITO) or aluminium-doped zinc oxide (AZO). The extraction electrode preferably has a thickness between 5 nm and 500 nm, more preferably between 20 and 200 nm.

The distance between the extraction electrode and the nozzle preferably is much smaller than the distance between the print head and the substrate, such that strong electrical fields might be formed by the extraction electrode locally in close proximity to the nozzle, but not in the interval between the print head and the substrate.

Limitation of the width of the extraction electrodes enables tight lateral localization of the strong electric field regions to where the individual nozzles are located, wherein said tight lateral localization of the electric field supports denser nozzle arrangements. However, any reduction of the width of the extraction electrode at the same time also increases the inhomogeneity of the electric field along the intended flight trajectory of an ejected droplet. Please note that most preferably the axial component of the electric field at the intended flight trajectory of an ejected droplet has its maximum intensity right at the liquid meniscus and monotonically decreases until it quickly converges to a constant intensity (on a length scale that is comparable to the width of the ejection channel) that is formed by the uniform field created by the acceleration electrode. Axial field inhomogeneity here describes a situation in which the axial electric field does not behave monotonic anymore but instead obtains at least one local minimum that is commonly located in proximity of the print head outside of the ejection channel, wherein the field intensity may approach zero at said minimum or even change sign (i.e. polarity). Due to such inhomogeneous axial electric fields droplets that are ejected from the nozzle might be decelerated and are therefore also more affected by lateral electric fields, which otherwise are preferably much lower in intensity than axial electric field. In certain cases, particularly if the electric field changes polarity, the ejected droplets might even be guided backwards or radially outwards towards the extraction electrodes and be deposited on them or on any other layer that blocks that flight trajectory of the droplets towards the extraction electrode. The acceleration electrode can be used to prevent such a deceleration and/or rebounding of the ejected droplets in that it can be used for homogenizing the electric field at the position where otherwise an intensity minimum would be expected and thereby secures acceleration of the ejected droplets towards the substrate (i.e. it reduces the depth of the intensity minimum or even prevents its formation). The acceleration potential can further help preventing lateral deflection of an ejected droplet by another droplet nearby, by the electrode assigned to another distant nozzle or by possible residual charges present on the substrate or by any other electric noise, respectively. Once an ejected droplet leaves the proximity of the strongly inhomogeneous electric field generated between the extraction electrode and the convex meniscus of the liquid, it will enter a region of uniform field density that is established between the acceleration electrode and the device electrode. This uniform acceleration field will drive the droplet to an equilibrium velocity that depends on the strength of the uniform electric field, the size and the electrical charge of the droplet.

The acceleration electrode can be used as a global electrode that is located below the substrate and which can thus act globally on every single nozzle comprised on the print head at the same time. The acceleration electrode is preferably always turned on. For an ejected droplet to be accelerated along the intended direction, i.e., along the direction of ejection, the applied acceleration potential relative to the liquid potential should be of the same polarity and preferably of higher amplitude as compared to the applied extraction potential relative to the liquid potential during droplet ejection. The acceleration field preferably is exactly orthogonal to the surfaces of the substrate and of the print head such that droplets are accelerated normal to the print head surface without being laterally deflected.

The optimal width of an extraction electrode to be employed for achieving highest density nozzle arrangements can be related to the diameter of the nozzle it is surrounding and is preferably chosen between half the nozzle radius and ten times the nozzle radius it is formed around, more preferably it is chosen between one times the nozzle radius and four times the nozzle radius. The nozzle diameter and the nozzle radius are hereby to be understood as being the outer diameter of the nozzle wall and being half of this diameter, respectively. Adjusting the width of the extraction electrode allows adjusting the shape and the strength of the electric field generated at the nozzle. For example, increasing the width of the extraction electrode results in generally stronger electric fields established at the convex meniscus. At the same time, an increased width of the extraction electrode enhances the electric field generated at the center point of the convex meniscus as compared to the strength of the electric field present at the outer regions of the convex meniscus. In the following this relation between the electric field established at the center point of the convex meniscus and the electric field established at the outer regions of the convex meniscus will be denoted as field ratio, wherein a high field ratio indicates a higher relative electric field present at the center point of the convex meniscus, and a low field ratio indicates a lower electric field present at the center point of the convex meniscus, respectively. A high field ratio favors the development of a meniscus having the desired convex shape wherein a low field factor may instead favor the development of undesired meniscus shapes, such as donut-like shapes. Please note that the field ratio of any nozzle is preferably defined for a convex meniscus shape, while in reality one may actually form an undesired donut-shaped meniscus. At the same time different nozzles may form convex menisci that have unequal geometries (e.g. with different curvature), wherein such variations of the actuated liquid geometry have an influence on the field ratio itself. For the sake of simple comparability it is therefore preferable to collect the field factor by numerical electrostatic simulations, wherein the shape of the convex meniscus is a boundary condition that is equal for any analyzed nozzle shape, preferably it is assumed to be of hemispherical form. Here we will denote a field ratio of above one as being the case when the electric field established at the center point of the convex meniscus is strongest as compared to any other point on the convex meniscus once the meniscus has been fully developed, i.e., just before droplets will be ejected. Besides increasing the width of the extraction electrode, one can also increase the field ratio by increasing the inner radius of the extraction electrode. Both methods result in an increasing areal footprint of the nozzle which is why a more preferable method is the introduction on an axial separation between the extraction electrode and its respective nozzle. This is achieved by forming sufficiently thick insulator layers for the accommodation of said extraction electrode, such that a desired axial separation is obtained. Preferably, the thickness of all insulator layers arranged between a given extraction electrode and the device layer has a thickness between half the nozzle radius and four times the nozzle radius of the respective nozzle arranged with that extraction electrode, more preferably between one times the nozzle radius and two times the nozzle radius of the respective nozzle arranged with that extraction electrode, respectively. As an example, the formation of extraction electrodes for two differently sized nozzles may involve in a first step the deposition of an upper insulator layer (e.g. the first insulator layer) on the device layer according to the requirements of a smaller nozzle type, in a second step the formation of the upper extraction electrodes (e.g. the first extraction electrodes) on said upper insulator layer, in a third step the deposition of a lower insulator (e.g. a further insulator layer) on top of the upper insulator layer, thereby embedding the upper extraction electrode in between the upper and lower insulator layer, and in a third step the formation of lower extraction electrodes (e.g. further extraction electrodes) on top of the lower insulator layer, wherein the thickness of the lower insulator layer is chosen such that the total thickness of lower and upper insulator layer is in line with the thickness requirements for a larger nozzle type. Additional further insulator layers may be formed according to this procedure if even larger nozzles have to be accommodated on the print head for which the respective further extraction electrodes are preferably situated even further apart from the nozzle.

Nozzles having slightly varying diameters can employ one single insulator layer of a thickness that fulfills the requirements associated with all of these nozzles. Especially, because there is no compulsory axial separation between the nozzle opening and the extraction electrode. Other properties of the print head system, such as, e.g., the width of the ring trenches or of the extraction electrodes, may normally be capable of compensating the variations in said axial separation.

If several nozzles are to be actuated by a common voltage signal it is also possible to arrange extraction electrodes on the print head that are larger than the distance between adjacent nozzles, i.e., such an extraction electrode can extend over two or more nozzles, and these two or more nozzles can thus be addressed by the same extraction electrode that essentially merges two or more extraction electrodes into one. In that case, openings in said extraction electrode have to be centered above the particular nozzle openings such that droplets can still be ejected. According to this particular method, the width of an extraction electrode can be increased without increasing the areal nozzle footprint.

The droplet diameter can be considerably smaller than the nozzle diameter it is ejected from. The convex meniscus has a diameter which is generally given by the outer diameter of the annular nozzle wall in the region of the nozzle opening. If the nozzles comprise wet stop plateaus, which will be introduced further below, the diameter of the convex meniscus is approximately given by the diameter of the wet stop plateau. Generally, the droplet diameter can be adjusted from about 1/20 of the nozzle diameter to one times the nozzle diameter by changing the voltage applied to the nozzle, but in principle even droplet diameters below 1/20 of the nozzle diameter are possible. A change in voltage can thus lead to differently sized droplets whose diameters decrease when the applied voltage is increased. Largest variations in the droplet diameter can be achieved if the applied voltages are slightly increased between the minimal extraction voltage necessary for droplet ejection and extraction voltages that are approximately twice as high as the minimal extraction voltage. If, however, the applied extraction voltage is further increased, the droplet diameters will be affected to a lesser degree.

The use of large nozzles for the deposition of much smaller droplets has several advantages: i) Large nozzles are much easier fabricated by conventional microfabrication methods. This can greatly affect the cost and the time needed for the print head fabrication as resolution requirements are lowered. ii) In order to print a certain area on a substrate with structures of a given resolution, larger nozzles allow for a faster printing than smaller nozzles. iii) The volumetric ejection rate and droplet size is much less affected by voltage variations if the ejected droplets have a diameter which is considerably smaller than the nozzle diameter. This ensures that droplets deposited from different nozzles have all the same diameter and are ejected at the same frequency even if slight fabrication differences are encountered. iv) The clogging of large nozzles, e.g., caused from dried ink or pollutants that attach to the print head, is less likely. Additionally, large nozzles are cleaned more easily.

Besides varying the applied extraction voltage, the droplet diameters can alternatively be adjusted by changing the nozzle diameters. A print head may comprise nozzles that all have the same diameter, but it can also comprise a variety of differently sized nozzles in order to print lines of different widths or to optimize printing speed and resolution. The optimal choice of acceleration voltage and extraction voltage might most easily be achieved if only one nozzle diameter is used. For example, one may use higher electric acceleration fields if only one nozzle diameter is present on the print head as compared to the situation when a particular nozzle is used in parallel with a much larger nozzle. When a variety of differently sized nozzles are constructed on the print head, it is preferred not to mix nozzles having very large diameters with nozzles having very small diameters. Otherwise, one runs the risk of not being able to use certain global settings, e.g., the acceleration potential, the device potential or the shielding potential, such as to meet the requirements of the individual nozzles.

The extraction electrodes eventually have to be connected to a voltage supply. This can involve the formation of a conductive path on the empty parts of the print head. Since some of the conductive paths may be activated, i.e., actuated at an electric potential that corresponds to the extraction potential required for printing, while others are not, they might establish a voltage between each other and therefore preferably are electrically insulated from each other, especially when there is the requirement for crossings between individual conductive paths. This may be resolved by introducing locally patterned insulator patches that act as a bridging elements or by locally lifting one of two crossing conductive paths onto another insulator layer. Because conductive paths are connected to extraction electrodes or other electrodes contained on the print head (more information below), said electrodes must be laterally spaced and insulated from each other as well, at least if they obtain different voltage signals between which crosstalk must be prevented (e.g. by electrical breakdowns).

While generally lateral electric fields at the main nozzle axis are to be circumvented, their controlled introduction can be employed for user-defined, quick deflections of ejected droplets. This can be achieved by splitting an extraction electrode into at least two segments of equal semiannular shape that are uniformly arranged around their respective nozzle and that enclose a lateral separation between their opposite ends. The at least two segments can be connected to individual voltage leads by individual conductive tracks that are orthogonally connected to the center of the outer curved edge of the respective at least two semiannular electrode segments. Instead of applying a common extraction potential to said electrode segments, they can be operated with slightly different electric potential such that a defined lateral electric field is generated in between them and at the meniscus, wherein said lateral component can lead to the ejection of droplets with a tilting angle with respect to the normal axis between substrate and nozzle and to the further deflection of a droplet along the principle direction of said tilting angle, once the droplet is ejected. Once the droplet leaves the ejection channel, its further deflection will quickly diminish as the droplet leaves the influence of the extraction electrode and enters the uniform electric field generated by the acceleration electrode. The voltage between the electrode segments must be chosen small enough such that an ejected droplet will not collide with the ejection channel. Accordingly, the range of possible deflections is limited to an area that is approximately given by the opening diameter of the ejection channel. While the use of two extraction electrode segments only allows the deflection along one axis, the use of three electrode segments adds the additional operational freedom that is required for two-dimensional deflection capabilities.

Extraction electrode segments are preferably arranged separately from each other such that they are not shortened. The distance between each of the segments should be chosen at the smallest possible separation that still allows sufficient insulation such that no breakdown occurs between said segments at the full range of voltages to be applied between them. Preferably, in order to reduce field gradients the gap region between two opposite segments is formed as a linear cut with rounded edges.

Local inhomogeneities in the electrical fields created by the extraction electrodes can be a possible secondary effect that is generated with the electrode set-up described so far. Indeed, narrowing the width of the extraction electrodes and axially displacing them away from the nozzle openings along the desired flight direction of the ejected droplets might even enhance these inhomogeneities. This can be compensated for by applying a larger absolute potential to the device electrode relative to the liquid potential. Because this electrode can cover the whole print head surface, it can be used to actively compensate for the inhomogeneities in the electric fields created by the extraction electrodes. However, the use of the device electrode as compensation for field inhomogeneities is somewhat limited because the closeness of the device electrode to the nozzles strongly limits the applicable absolute electric potential relative to the liquid potential that can be applied to the device electrode. The electric potential applied to the device electrode should preferably not cause droplet ejection by itself. This action of turning specific nozzles on or off is still preferably performed by the extraction electrodes only.

The problem of field inhomogeneities can be particularly pronounced when arranging nozzles of strongly varying diameter on the same print head. In this case, the droplets ejected from the smallest nozzles would have to pass through an ejection channel that is very long compared to the width of the respective nozzles they are ejected from (i.e. it has a high aspect ratio). The high aspect ratio ejection channel will partly block the electric field generated by the acceleration electrode from coupling to the deeply embedded extraction electrodes and may thereby provoke rebounding of the ejected droplets due to insufficient field homogenization. This situation may be partly prevented by increasing the width of the ejection channel of an affected nozzle or by increasing the width of the respective extraction electrode.

However, the beneficial impacts that can result from increasing the width of the extraction electrode or the diameter of the ejection channel can lead to negative impacts, as well. In particular, it can result in a strong increase of the required extraction voltages or it can negatively affect the areal footprint of the respective nozzles or both. To make use of a larger range of extraction voltages without suffering from droplet rebounding and without suffering from the specific negative impacts mentioned above, one preferably uses an additional electrode that is strongly coupled to the extraction electrode but that is not or only slightly coupled to the grounded nozzle. At least said electrode is preferably decoupled from the nozzle by the amount required for preventing droplet ejection at the whole desired range of electric potentials that are intended to be applied to it relative to the liquid.

For this purpose, a shielding layer can be formed preferably on top of a terminal insulator layer, i.e., on an insulator layer that is deposited onto the lowest further insulator layer (i.e. the one that is closest to the substrate), said terminal insulator layer containing circular holes that extend the ejection channel all the way through the terminal insulator layer. The shielding potential relative to the liquid potential preferably has the same polarity as the extraction potential relative to the liquid potential during printing.

The shielding layer is preferably formed as a continuous layer on top of the terminal insulator layer but contains openings at the location of the ejection channel, wherein this opening can also be larger than the diameter of the ejection channel it surrounds, preferably the openings are equally large or larger than the inner diameter of the extraction electrodes that they at least partially cover but smaller than the outer diameter of said extraction electrodes. The terminal insulator layer preferably has a thickness between 100 nm and 10 μm, more preferably between 200 nm and 2 μm. Preferably the shielding layer is axially arranged as close as possible to that extraction electrodes which are situated on the other side of the terminal insulator layer and hence the terminal insulator layer is preferably chosen at the least thickness that still prevents electrical breakdown at the full range of voltages to be applied between said extraction electrode and the shielding layer. The shielding layer may also be used as an etching mask during the formation of the ejection channel. In addition to preferably covering at least beyond the outer circumference of any extraction electrode on the print head, the shielding layer more preferably also covers as a uniform layer the conductive paths or any other source of electric fields that is formed on the print head and that is close to a nozzle. Preferably the shielding layer laterally extends as a uniform layer beyond the outer circumference of any extraction electrode and thereby covers any source of electric fields, except at the positions of the ejection channels, within a lateral distance from said extraction electrode that is equal to at least a quarter of the distance between print head and substrate, more preferably by at least half the distance between print head and substrate. The electric fields originating from covered electric field-generating sources may therefore be efficiently shielded from axially coupling to nozzles they are not supposed to couple to.

A main aspect of the shielding layer is its use for the purpose of providing an electric field that can overcome the field-inhomogeneity generated by narrow extraction electrodes. In order to fulfill said aspect, the shielding layer preferably covers sufficiently far beyond the outer circumference of an affected extraction electrode and receives the absolute shielding potential relative to the liquid potential that is high enough to eliminate any minimum in electric field intensity (created by the field-inhomogeneity) along the intended droplet trajectory during droplet ejection. This may be achieved if the shielding potential relative to the liquid potential is higher, equal to or lower than the extraction potential relative to the liquid potential during droplet ejection. The homogenization effect of the shielding layer is strongest if its absolute potential relative to the liquid potential is higher than the extraction potential relative to the liquid potential. However, preferably, the shielding potential relative to the liquid potential is smaller than the extraction potential relative to the liquid potential during printing. A lowest possible shielding potential relative to the liquid potential implies least deflective power of a nozzle on the droplets ejected from a neighboring nozzle and therefore further reduces crosstalk between nozzles. Without loosing the homogenization effect of the shielding electrode, the absolute shielding potential relative to the liquid potential may be minimized by minimizing the thickness of the terminal insulator layer, as described above. Since the shielding layer is preferably formed above the extraction electrode, it is not only located further away from the nozzle but efficiently blocked by the extraction electrode from electrically coupling to the nozzle. As a consequence, the shielding layer is not restricted to a low absolute shielding potential relative to a liquid potential when fulfilling the task of compensating field-inhomogeneities, because the shielding potential, in difference to the device potential, does not readily cause droplet ejection by itself. The use of a lowest possible absolute shielding potential relative to the liquid potential can also minimize the influence of the shielding layer on the grounded nozzle. Said influence may be further reduced by increasing the outer diameter of the extraction electrode (while keeping its inner diameter constant). This can increase the coupling between the extraction electrode and the nozzle, while at the same time the coupling between the nozzle and the shielding layer can be reduced. However, please note that the presence of a shielding layer can imply that a widening of the extraction electrode may result in a reduction of the field factor, in contrast to the case when no shielding layer is provided. Especially, this can apply if the absolute shielding potential relative to the liquid potential is lower than the extraction potential relative to the liquid potential. Again, an increase of the shielding potential relative to the liquid potential can lead to higher field ratios.

In order to allow acceleration of ejected droplets into the correct direction the shielding potential relative to the liquid potential is preferably chosen smaller than the acceleration potential relative to the liquid potential.

In difference to the previous descriptions it is also possible, for example, to apply the highest absolute electric potential to the nozzle and to apply electrical ground to the acceleration electrode. As long as the requirements on the voltages forming between an electrode and the nozzle and in between any two electrodes are still in line with the general disclosed considerations, the choice of the nozzle potential is up to individual preference. However, the realization of a system using a grounded nozzle is generally causing least implementation difficulties and is therefore the preferred embodiment.

The use of a shielding layer is also compatible with the use of differently sized nozzles that are arranged on the same print head. Nevertheless, this can pose some difficulties because one will generally want to embed the extraction electrodes associated with smaller nozzles in closer proximity to the device layer than the extraction electrodes associated with larger nozzles. However, the shielding layer can be located at a same height for all nozzles comprised on the print head, i.e., preferably on top of the terminal insulator layer. Accordingly, if nozzles of different sizes are comprised on the print head, the shielding layer might be located further away from extraction electrodes associated with smaller nozzles than from extraction electrodes associated with larger nozzles. Such a larger spacing can imply a lower electrode coupling and consequently can demand an increase of the absolute shielding potential applied to the shielding layer in order to overcome the inhomogeneity of the electric fields that can be created by the embedded extraction electrodes. If the extraction electrode associated with a small nozzle receives the same extraction potential as that received by a larger nozzle, coupling may be insufficient in the case of the small nozzle. However, this can be overcome by making use of the fact that small nozzles require lower voltages for actuation than comparably larger nozzles (explanations given later). Said finding can be employed by forming extraction electrodes that are operated at a lower absolute extraction potential relative to the liquid potential than extraction electrodes associated with larger nozzles. A reduction of the absolute extraction potential relative to the liquid potential can compensate for the lower coupling-efficiency established between the extraction electrode and the shielding layer since the shielding potential relative to the liquid potential will increase relative to the voltage that is formed between extraction potential and liquid potential. For example, the voltage applied to the extraction electrode associated with the largest nozzle on the print head may be 400 V while the shielding electrode only requires an electric potential of 230 V in order to enable the generation of a homogeneous electric field for this nozzle. At these conditions, the extraction electrode of an approximately ten times smaller nozzle may be chosen at around 250 V. In this case, the extraction electrode associated with the smaller nozzle is subjected to almost the same electric potential as the shielding electrode, but the voltage between the shielding electrode and the extraction electrode has in this case increased from −170 V to −20 V.

An improvement may be achieved if additional intermediate extraction electrodes (also referred to as homogenization electrodes) are employed for those nozzles that suffer from field inhomogeneity. Such a homogenization electrode can be formed in the same manner as the extraction electrode, i.e., as a ring electrode around the respective nozzle, but preferably at an intermediate distance between the extraction electrode and the shielding layer on a further insulator layer. Homogenization electrodes are preferably formed on existing further insulator layers that are already occupied by the extraction electrodes of other nozzles, such as to minimize fabrication effort. If necessary, additional further insulator layers may be formed and covered with the homogenization electrodes in the course of building the layer stack.

The homogenization potential applied to the homogenization electrode can be adjusted such that the electric field established along the air void in the ejection channel can be equally strong into both directions of the homogenization electrode, i.e., into the direction towards the extraction electrode as well as towards the shielding layer. For example, if the electric field between the extraction electrode and the homogenization electrode is stronger than the electric field established between the homogenization electrode and the shielding electrode, one should preferably reduce the absolute homogenization potential applied to the homogenization electrode relative to the liquid potential. By doing so, one can reduce the relative strength of the electric field formed between the extraction electrode and the homogenization electrode in favor of the electric field established between the homogenization electrode and the shielding electrode. The homogenization electrodes thus also serve the purpose of minimizing electrical field inhomogeneities. In the case of the above example the homogenization electrode may be formed halfway between the shielding layer and the extraction electrode and can be actuated with a homogenization potential of around 180 V. If the differences in size between the nozzles comprised on the print head become very large, one may even use more than one homogenization electrode for the smallest nozzles. The homogenization electrodes may be turned on and off in phase with their respective extraction electrodes, but for operational simplicity the homogenization electrodes are preferably constantly turned on, similar to the device potential applied to the device electrode and the shielding potential applied to the shielding layer and acceleration potential applied to the acceleration electrode.

The homogenization electrodes preferably are connected to a voltage supply. This can involve the formation of conductive paths on the empty parts of the print head. Because homogenization electrodes are preferably constantly turned on, they do not receive individual triggering sequences and accordingly the conductive paths of all homogenization electrodes receiving the same potential may eventually be merged and hence do not have to be electrically insulated from each other.

Using voltages of different amplitude, e.g. for actuating nozzles of different width, can increase the complexity of the electrical driving circuitry. However, it is well known that the voltage of a given circuit can be split between two capacitors, in case they are arranged in a serial manner. In this way, a first voltage $U_1$ formed between the extraction electrode and a grounded nozzle is approximately calculated according to the following formula:

$$U_1 = U \cdot \frac{C_2}{C_1 + C_2} \tag{1}$$

In the above formula, U is the total applied voltage, i.e., the electric potential difference established across the whole circuit, $C_1$ is the capacitance of the nozzle, and $C_2$ is the serial pre-capacitance. Please note that in this calculation the capacity of the nozzle may not only include the charge stored on the nozzle but also the charge that is stored between the extraction electrode and the device electrode and between any part of the conductive path and the device electrode, respectively. The latter may be considerably larger than the former and depends on the length of the conductive path that is used to funnel a certain extraction potential to a particular extraction electrode. In order to be able to adequately adjust the extraction potential at the particular extraction electrode, it is desired to form a capacitance $C_2$ that is comparable to $C_1$. Such a capacitance is most effectively formed by axially separating the conductive path from its extraction electrode by means of a further insulator layer.

The extraction electrode is preferably extended by an electrode extension that is preferably formed as a line with orthogonal attachment to the extraction electrode. The electrode extensions of extraction electrodes are preferably formed as narrow as possible by the chosen fabrication methods. A particular extraction electrode and its electrode extension are kept as a floating conductor.

The voltage received by the electrode extension and its extraction electrode can be capacitively coupled to it from the conductive path. Preferably, the conductive path is formed exactly on top of the electrode extension. It may cover the whole electrode extension or only part of it. In the latter case, the uncovered part of the electrode extension preferably is arranged on that side that leads towards the extraction electrode. The conductive path preferably never approaches the extraction electrode laterally closer than half of the outer ring trench diameter, such that it does not directly couple to the grounded nozzle but only to the corresponding, electrically floating, electrode extension. Due to the electrical coupling that can be established between the conductive path and the electrode extension line, both the electrode extension and the extraction electrode preferably are subjected to the same electric potential. In order to allow optimal coupling, the conductive path preferably is at least as wide as the underlying electrode extension along the overlapping regions. Preferably the conductive path is slightly wider than the electrode extension in the overlapping regions, preferably by at least half of the thickness of the further insulator layer that separates the conductive path from the electrode extension.

The value of the electric potential that is capacitively coupled to the extraction electrode can be controlled by changing $C_1$ and $C_2$ according to the above stated formula. Adjustments of these two capacitances can be achieved by two major design methods.

First, one can control the thickness of the further insulator layer that separates the conductive path from the electrode extension. If this further insulator layer is thicker than the at least one insulator layer that separates the electrode extension from the device electrode, it might not be possible to generate a capacitance $C_2$ that is equally large as the capacitance $C_1$. In order to achieve a higher relative value of $C_2$ compared to $C_1$ it is possible to increase the thickness of the at least one insulator layer between the electrode extension and the device electrode or decrease the thickness of the further insulator layer that separates the electrode extension from the conductive path, respectively. Another way of adjusting $C_1$ and $C_2$ can be achieved by setting a relative fraction where the conductive path overlaps with the underlying electrode extension. A larger overlapping area implies stronger overall coupling between the electrode extension and the conductive path which can thereby also increase $C_2$ with respect to $C_1$.

Please note that the voltage that is coupled to the extraction electrode might not be calculated accurately by the above formula if the device electrode is not subjected to the same potential as the nozzle, i.e., on electrical ground. If the device layer is not grounded, then the electric potential that is induced at the electrically floating extraction electrode might be sensitive to the polarity of the electric potential that is applied to the conductive path. If the device potential applied to the device electrode is of the same polarity as the potential applied to the conductive path, one can induce a higher voltage at the extraction electrode than what would follow from the above formula.

Along this line the device potential applied to the device electrode preferably is sufficiently small such that it does not cause droplet ejection by itself or indirectly by electrical coupling to the extraction electrode. However, it is generally preferred to keep the device electrode electrically grounded such that it does not cause any asymmetry in the electrical field.

A further major influence on the induced voltages might be caused by the shielding layer. This electrode is generally subjected to a relatively high shielding potential and may therefore induce substantial capacitive coupling. Again, said coupling should preferably be reduced such that droplet ejection is prevented while the conductive path is at electrical ground, i.e., whenever droplet ejection is intended to be deactivated. Sufficient decoupling may be achieved by covering most of the electrode extension with the conductive path and by forming said conductive path with a slightly larger width than the electrode extension. This essentially shields the electrode extension against influences from the shielding layer. However, some part of the electrode extensions as well as the whole extraction electrode might not be covered by the conductive path and might thus be exposed. Further reducing the influence of the shielding layer can be achieved by increasing the thickness of the upper insulator layer, preferably by making it thicker than both the lower insulator layer and the further insulator layer. This can generally be implemented since the capacitive method, which relies on reducing the applied voltages, is mainly used for the smallest nozzles comprised on the print head, i.e., for those nozzles which are preferably embedded in a thick lower insulator layer.

Capacitive contacting of an electrode is also applicable to homogenization electrodes, wherein the homogenization electrode can be capacitively contacted according to the same set of rules that have been laid out for the case of capacitively contacting an extraction electrode.

As already specified, the device layer is preferably made of an electrically conducting material. In the context of the present invention, electrically conducting means that the electrical conductivity of the device layer is preferably at least five orders of magnitude, more preferably at least eight orders of magnitude, most preferably at least ten orders of magnitude higher than the electrical conductivity of the stop layer. In any case, the conductivity of the device layer is preferably adjusted such that it maintains equipotential along its whole continuous extent, i.e., that there is no voltage drop occurring along the device layer, wherein no voltage drop means that the device potential established by a voltage source on the device layer preferably varies by less than 10%, more preferably by less than 1%. If this criterion is fulfilled, the device layer may act as the device electrode by itself.

However, if the device layer is not sufficiently conductive to be used as a device electrode that fulfills the equipotential criterium it may be covered by a layer comprising a material of high conductivity. In particular, the device layer can be coated with a device coating that comprises a conductive material, preferably a metal. The device coating preferably has a thickness between 10 nm and 1 μm, more preferably between 30 nm and 300 nm.

This device coating can provide good electrical contact to the device layer and can set it to the required device potential even if the device layer has a very low electrical conductivity, wherein very low means that its electrical conductivity is preferably still higher than that of the stop layer, at least by such an amount that the voltage drop between device coating and liquid reservoir takes place primarily across the thickness of the stop layer and not across the thickness of the device layer. The device coating may also cover the distal end surface of the nozzles and be covered by the etch-resistant etch-stop layer (details below). In this case, the device coating is preferably chosen to comprise a material that is etched to a lesser degree than the material the nozzle wall is made of. If the device coating resists the etching process that is used to create the wet-stop plateau, the part of the device coating that covers the distal end surface may adopt the functionality of the etch-stop layer such that an additional etch-stop layer can be omitted and the wet-stop plateau can hence be formed by the device coating.

The electric field strengths formed between the acceleration electrode and the device electrode may be above the dielectric strength of air (~3 MV/m). Since air can be present between the print head and the substrate, the surface of the print head is preferably covered with an insulating protective coating after the formation of all the electrodes. The insulating protective coating preferably comprises or consists of a material having a good dielectric strength that blocks electricity from breaking through the air, such as, e.g., $SiO_2$, $Si_3N_4$ or $Al_2O_3$.

Please note that inhomogeneous electrical fields established close to the meniscus may be locally much stronger (e.g., greater than 100 MV/m) than the uniform electrical fields caused by the acceleration electrode. However, because these inhomogeneous electrical fields are generally formed on dimensions of only a few micrometers, they profit from the well-known Paschen law that states that the dielectric strength of a medium increases if the distance between leads is in the range of only about 10 μm or less. Furthermore, the electrodes employed on the print head are preferably embedded in dielectric materials in all direction, e.g. the first extraction electrode can be embedded in between the first insulator layer and a further insulator layer, while the shielding electrode can be embedded in between the terminal insulator layer and the insulating protective coating.

The liquid supply reservoirs can be formed from the liquid supply layer by anisotropic etching. Preferably, the liquid supply reservoirs are formed from a liquid supply layer made of silicon according to a $SF_6$ based Bosch process. The sidewalls of the liquid supply reservoirs preferably enclose an angle of about 90° with the underlying stop layer. The stop layer hereby may also act as an etch-resistant etch-stop film that prohibits the $SF_6$ from destroying the nozzles. By employing the Bosch process, it is possible to form aspect ratios of more than 50, i.e., the depth of the liquid supply reservoirs being fifty times larger than its width. For example, when employing a liquid supply layer having a thickness of 300 μm, the liquid supply reservoirs may obtain a width of 6 μm or less. However, the aspect ratio of the liquid supply reservoirs is preferably smaller than 50, more preferably smaller than 30. The liquid supply layer preferably is at electrical ground and preferably has a thickness between 200 μm and 1 mm.

The liquid supply layer can be in physical contact with one or more additional liquid supply layers that can be deposited on top of the liquid supply layer. The additional liquid supply layers can form liquid supply channels through which the liquids can be distributed to the liquid supply reservoirs formed by the liquid supply layer. In principle, the one or more liquid supply layers and the additional liquid supply layers could be merged into a single layer that performs both of these functionalities. Such embodiments may be based on approaches used in microfluidics, which are known to everyone skilled in the art. The liquid supply reservoirs and the liquid supply channels can either be manually or automatically filled with liquid. Each liquid supply reservoir and each liquid supply channel can serve one or more nozzles with liquid, wherein all liquid supply reservoirs and liquid supply channels can be filled with the same ink (liquid containing the material to be printed) or ink filled into a given liquid supply reservoir or a given liquid supply channel can be chosen from at least two different inks.

In general, the concave meniscus will be fixed inside the nozzle in the region of the nozzle opening, i.e., it will not get out onto the nozzle front surface, wherein the nozzle front surface is understood as the surface that faces the substrate, independent of the embodiment. If the liquid is being actuated by a sufficiently strong electric field, it changes its geometry towards a convex meniscus that protrudes out of the nozzle opening. If the nozzle front surface is wettable, the convex meniscus will most likely move from the region of the inner nozzle wall surface of the nozzle out towards the outer nozzle wall surface. If the nozzle wall surfaces are very wettable, i.e., enclosing a contact angle with the liquid of less than about 30°, especially if they are completely wettable, i.e., enclosing an equilibrium contact angle with the liquid of essentially zero degrees, liquid may be further drawn into the ring trenches, which has to be prohibited.

This action can mostly be circumvented by specifically coating the surfaces of the print head. The liquid-repellent surface coating preferably is surface-energy decreasing and preferably comprises a polymeric and/or organic material, more preferably it comprises polytetrafluoroethylene. Preferably, the surface coating is applied by a vapor coating process, most preferably by a (plasma assisted) chemical vapor deposition process. The latter technique allows for thick coatings of several tens or hundreds of nanometers that are very robust to mechanical wear. Preferably, the thickness of the low-energy surface coating is between 1-1000 nm, more preferably it is between 50-500 nm.

However, if the liquid-repellent surface coating is applied to the walls of the liquid supply reservoirs, of the liquid supply channel or the interior surface of the nozzle (i.e. the inner nozzle wall surfaces), said liquid-repellent surface coating preferably is at least slightly wettable towards the liquid, i.e., the contact angle enclosed between a particular wall and the liquid preferably is smaller than 90°. Otherwise one might not be able to fill the liquid into the liquid supply reservoirs or into the additional liquid supply reservoirs, respectively. In comparison, the liquid-repellent surface coating that may be applied to the exterior of the annular nozzle wall or to the nozzle front surface may also be non-wettable towards the liquid, i.e., the contact angle enclosed between them and the liquid can be larger than 90°. Preferably, the surface coating is at least coated on all surfaces beyond the nozzle opening on the side of the print head that faces the substrate, while preferably leaving the interior of the nozzle and the liquid supply reservoirs and/or liquid supply channels free of said surface coating.

As already mentioned, it is important that the actuated convex meniscus does not wet into the ring trench but remains at the outer annular nozzle wall. However, in certain cases, just having a liquid-repellent surface coating on the annular nozzle walls may not be sufficient in order to circumvent the wetting of the convex meniscus into the ring trench. In particular, the nozzle geometry can be adjusted in that, in a first step, the device layer can be coated with an etch-stop layer. The etch-stop layer preferably comprises an etch-resistant and dielectric material, such as, e.g., $SiO_2$, $Si_3N_4$ or $Al_2O_3$. In a second step, a contact angle discontinuity can be formed in the etch-stop layer in the region of the ring trenches.

The contact angle discontinuity can have the form of a sharp transition which is formed preferably at the front side of the annular nozzle wall. The contact angle discontinuity can be created by isotropic etching. It is therefore preferred to protect the nozzle and other elements of the print head with an etch-resistant etch-stop layer. Preferably, it is said etch-stop layer that is used to actually create the discontinuity, preferably in the form of a wet-stop plateau. The etch-resistant etch-stop layer is preferably made of a material that is different from the material comprised in the annular nozzle wall. In this way, isotropic etch chemistry can be employed, according to a wet or dry etching process, that selectively removes part of the annular nozzle wall material located underneath the etch-resistant etch-stop layer. For example, if the annular nozzle wall is made of silicon, a useful material for the etch-resistant etch-stop layer would be $SiO_2$ or $Al_2O_3$, wherein the employed etch chemistry may be chosen from a $SF_6$ plasma (according to a dry etching process) or a nitric acid based wet etchant.

Preferably, said isotropic etching process is performed before the ring trench has been formed. In this case, said isotropic etching process can be regarded as a first step towards the formation of the ring trench from a layer of material, the material preferably comprising silicon, which will eventually be separated by the ring trench into the device layer and the annular nozzle wall. Essentially, in case the material layer is made of silicon, one can first etch into said material layer according to an isotropic etching process and then continue the etching according to a second, anisotropic etching process, e.g., according to an anisotropic Bosch process that combines $SF_6$ and $C_4F_8$ gases or a HBr-based process, that continues the etching process until the ring trench is formed. Thereby, lateral etching underneath the etch-resistant etch-stop layer can only continue for as long as the first, isotropic etching process is performed. Isotropic etching means that the etching occurs equally fast into all directions. Thus, the etching occurring in lateral direction can extend equivalently in width as its depth resulting from the etching occurring in axial direction, i.e., towards the stop layer. The etching occurring in lateral direction has a width that is less than the radial thickness of the annular nozzle wall, preferably less than half the lateral thickness of the annular nozzle wall. Especially, its preferred width is between 50 nm and 500 nm. The thickness of the etch-resistant etch-stop layer preferably is between 20 nm and 2 μm, more preferably between 50 nm and 500 nm. If a wet-stop plateau is to be formed and combined with a liquid-repellent surface coating, said surface coating is preferably only applied to the print head, once the wet-stop plateau has already been formed.

Preferably, the extraction potential applied to the extraction electrodes relative to the liquid potential is between 10 and 1000 V, more preferably around 400 V or lower. The applied extraction potential can be in the form of a DC voltage, preferably a continuous signal with either a constant or varying amplitude. Alternatively, the applied extraction potential can be in the form of an AC voltage, preferably in the form of a periodic function with a frequency preferably being between 20 Hz and 20 kHz. In case when a periodic function is applied, it preferably is a rectangular function with the same amplitude in plus and minus.

DC operation describes the case in which the electrical polarity of the signal applied to the extraction electrode and to any other electrode stays the same during the whole printing duration. It is preferred to actuate the electrodes comprised on the print head at the same polarity. However, the device electrode can regularly be actuated at a different polarity, as will be explained further below. DC voltages may be periodically or non-periodically adjusted in amplitude, without changing the polarity of the applied electric potentials. Applying a voltage having a non-constant amplitude can cause the ejection of droplets that have varying diameters. Accordingly, by changing the voltage, one can adjust the size of the ejected droplets and thus eventually also the width of the printed structures.

When performing a DC operation the ejected droplets are all charged at the same polarity, as well. Accordingly, after some droplets have impacted on the substrate, one may start to accumulate repulsive charges on said substrate, especially when the printing is performed onto a substrate that has insufficient electrical conductivity for conducting deposited charges away from the impact region in the course of an ejection period. This accumulated charge may lead to lateral deflections of incoming droplets which lowers the printing resolution or may even cause spraying effects. This can be mostly circumvented by ejecting equal amounts of droplets of opposite polarity at regular time intervals. One or a few droplets of a given polarity can be ejected in a burst, followed by an equally long burst of droplets of opposite polarity. Because the droplets ejected during these two bursts are of opposite polarity, the deposited charge is essentially neutralized in each cycle comprising two bursts. Herein, each burst simply represents one of the two polarity intervals of the voltage waveform, the two polarity intervals preferably being equally long. Preferably, the waveform is chosen as a square function having a fixed amplitude and a 100% duty cycle. The square waveform may be overlaid with a modulating waveform that periodically or non-periodically adjusts the amplitude of the extraction potential, preferably on timescales that are long compared to the period of the internal AC signal. This can have the same consequence as adjusting the amplitude that would be used for droplet ejection according to a DC operation. Furthermore, it is preferred to apply AC frequencies that are lower than the natural ejection frequency of the droplets at a given voltage, but which are preferably not lower than one tenth of said natural ejection frequency. By doing so, one can minimize the amount of equally charged droplets that are ejected in a single burst and consequently one can also minimize a potential deflection of the ejected droplets. Switching the polarity of the applied voltage signals is preferably done for all electrodes on the print head, and not only for one. If only one or a few electrodes would be switched in polarity, the ejected droplets then might not be ejected with the same characteristics, most likely they will be deflected or rebounded at some point. In case the extraction electrode is operated with an AC voltage, it is preferable that all other electrodes, including the acceleration electrode, the device electrode, the shielding electrode and the one or more homogenization electrodes employ an AC voltage as well, more preferably said employed AC voltage has the same frequency and phase as the AC voltage applied to the extraction electrode relative to the liquid, most preferably said employed voltage waveform only differs by a constant factor from the waveform applied to the extraction electrode relative to the liquid.

In case the extraction electrode is operated with a DC voltage, it is preferable that all other electrodes, including the acceleration electrode, the device electrode, the shielding electrode and the one or more homogenization electrodes employ a DC voltage as well, more preferably said employed voltage waveform during liquid ejection only differs by a constant factor from the waveform applied to the extraction electrode relative to the liquid An increase in the extraction field can also affect the frequency of droplet ejection. While droplets can become smaller with increasing extraction field, at the same time, one strongly increases the frequency at which these droplets are ejected. At the lowest possible voltages that still result in droplet ejection, the frequency can be in the range of below 10 Hz. If the voltage is increased to a value that is about twice as large as this minimal ejection voltage, the ejection frequency can reach values that are normally in the range of 1 kHz. Further increasing the voltage can further increase the ejection frequency to 10 kHz and may even reach values in the range of 100 kHz. Ejection frequencies are much more affected by high voltages than the droplet diameter. Generally, it is preferred to not use too high voltages in order to prevent electrical breakdowns and electrical charge repulsion effects. Preferably, the voltage regime is chosen at values that are about 1.5-2.5 times higher than the lowest possible ejection voltage. This regime is preferable also due to the fact that it is least affected by unwanted variations in electric fields or the like. In addition, it is particularly preferable that the voltage is never chosen in a regime that is below 1.5 times the minimal ejection voltage. In this voltage regime, the ejection frequency is very low which can negatively influence the dynamics of the print head. Furthermore, the system is very sensitive to any unwanted noise in electric field or the like. For example, even a small increase of the extraction field can result in considerable changes in the droplet diameters.

As stated before, adjusting the widths of the ring trenches and of the extraction electrodes can change the development and the strength of the electrical fields established in the region of the nozzles and can thereby act as important variables, e.g., in defining the formation of the convex meniscus shape. However, these variables cannot be adjusted anymore once the print head has been built. A way of dynamically changing the development and strength of the electrical fields in the region of the nozzle can be achieved by selectively manipulating the electric potentials applied to the field-forming electrodes, particularly those electrodes that most strongly couple to the nozzle, i.e. to the device electrode and the extraction electrode. For example, the achievement of stable ejection conditions (e.g. by generating field ratios above one) can be supported by employing a device potential relative to the liquid potential that is of different polarity compared to the extraction potential relative to the liquid potential (also referred to as inverse polarity situation). Generally, the use of the device layer as an electrode results in lower field ratios, i.e. stronger fields at the outer regions of the meniscus compared to the center region of the meniscus, as compared to the field ratios obtained by the extraction electrode. Using the device electrode at the inverse polarity situation causes electric fields that oppose the electric fields generated by the extraction electrode (i.e. they partly cancel each other), but because the device electrode mainly acts at the outer regions of the meniscus, electric fields generated by the extraction electrode are primarily quenched in said outer meniscus region, resulting in a superposed electric field with a higher field ratio than without usage of the device electrode.

The absolute device potential relative to the liquid potential preferably is smaller than the extraction potential relative to the liquid potential during printing.

As an example, if one applies a device potential to the device electrode having opposite polarity relative to the liquid potential than the extraction potential relative to the liquid potential, one might have to increase the amplitude of the extraction potential in order to still cause droplet ejection. This is different to the case when the device potential relative to the liquid potential is of equal polarity as the extraction potential relative to the liquid potential, in which case the device electrode supports droplet ejection and hence the minimal ejection voltage that has to be applied to the extraction electrode is smaller in amplitude compared to the situation in which the device potential relative to the liquid potential is zero.

The device electrode can be used to support droplet ejection if the device potential relative to the liquid potential is of the same polarity as the extraction potential relative to the liquid potential. By applying a device potential that is just below the intensity required for droplet ejection one can cause the formation of a convex meniscus but one cannot cause the ejection of droplets yet. Once the convex meniscus has been formed, droplet ejection can be caused by a applying an absolute extraction potential relative to the liquid potential that is much lower than what it would have to be if the device potential relative to the liquid potential was to be zero.

A benefit of using the device layer as a global ejection support electrode can be a better shielding obtained between the extraction electrodes of different nozzles. The drawback of employing the device layer at least partly for droplet ejection can be the inherent degradation of the field ratio which may have to be compensated for by, e.g., an increase of the width of the ring trenches. Due to uniformity and global nature of the device electrode it does not create field inhomogeneities such as those which are commonly generated by narrow extraction electrodes. Hence, if the use of a supporting device potential allows a decrease in the extraction potential relative to the liquid potential, also the field inhomogeneities can be quenched. In general the device layer can act as a global electrode for all nozzles comprised on the print head. In special cases, however, it may be cut into segments that are set to different device potentials by one or more voltage supplies. Those device layer segments can be created by forming a trench that progresses down to the insulating stop layer, similar to the ring trenches. As an alternative, one may employ a non-segmented device layer being made of an insulating material like $SiO_2$ or $Al_2O_3$, and coat it with a segmented device coating wherein said device coating adopts the full functionality of the device electrode and wherein each device coating segment can be operated with a different device potential.

The acceleration field generated at the nozzles by the acceleration electrode is generally much weaker than the extraction fields formed by the extraction electrodes. This is mainly due to the fact that the extraction electrodes typically are much closer arranged to the nozzles than the acceleration electrode, even though the extraction electrodes may use substantially lower voltages than the acceleration electrode.

In particular, it is preferred to apply an acceleration potential to the acceleration electrode that can create a uniform electric field between the print head and the substrate having a field strength between 0.5 MV/m and 50 MV/m, preferably between 1 MV/m and 20 MV/m. The acceleration potential relative to the liquid potential preferably is of the same polarity and of higher amplitude as compared to the extraction potential relative to the liquid potential during printing, such that a nearly homogeneous electric field with proper orientation is established between the print head and the substrate during printing.

Additionally, the strength of the uniform electric field generated by the acceleration electrode is preferably chosen such that it is more than two times, more preferably more than five times weaker than the electric field that must be formed at the convex meniscus in order to cause the ejection of droplets.

If several differently sized nozzles are present on the print head, said criterion is preferably based on the requirements associated with the largest nozzles comprised on the print head. The electric fields required for minimal ejection conditions can be approximated by the following formula:

$$E = \sqrt{\frac{\gamma}{\varepsilon_0 r}}$$

Wherein E is the electric field, y is the liquid surface tension, r is the radius of the convex meniscus and $\varepsilon_0$ is the vacuum permittivity. According to this formula, the required field strength for detaching a droplet from a 1 μm diameter meniscus is approximately 80 MV/m, while the required field strength for detaching a droplet from a 10 μm diameter meniscus is approximately 25 MV/m.

It is further preferable that the accelerating electric field, i.e. the electric field forming between print head and substrate, is on average, i.e., over the whole flight path between a nozzle and the substrate, at least ten times, more preferable at least a hundred times, most preferable at least a thousand times higher than the electric fields originating from other droplets or from other sources of lateral electric fields. This can secure that droplets stay on their intended trajectories and are consequently deposited at their intended locations even at substrate-nozzle separations that are considerably, e.g., orders of magnitudes, larger than the droplet diameter. The arrangements and operational conditions of electrodes disclosed in this invention indeed allow sufficient decoupling between individual nozzles even at high density intergration and thereby enable high-resolution and high-throughput printing even at comparably huge separations between print head and substrate. In particular, the ejection of droplets and their acceleration onto the substrate is performed by different electrode systems, of which one creates inhomogeneous, short-range and high-intensity electric fields (particularly the extraction electrode), while the other creates uniform, long-range but weaker electric fields that secure proper droplet guidance (particularly the acceleration electrode). Further electrodes (particularly the device electrode, the homogenization electrode and the shielding electrode) have the main purpose of enabling a reduction of the areal nozzle footprint on the print head and the high-density arrangements of nozzles while sustaining printing resolution and accuracy. For example, ejection of droplets from a nozzle having a diameter of ~5 μm and being positioned ~1 mm away from a substrate can result in printed structures having smallest lateral dimensions of less than 1 μm, wherein the separation of closely arranged nozzles on the print head may be less than 20 μm. Hence, structures can be created that are smaller than the nozzle diameter even though the separation between print head and substrate is more than 1000 times higher than the smallest lateral feature size.

Due to the wide form factor of the print head and the possibility for thickness variations or general wafer bow, one might have to use a sufficiently large spacing between the print head and the substrate. At the same time, the spacing is preferably chosen as small as possible, because a larger spacing may lead to excessive droplet impact distributions. The latter might be primarily caused by the possible occurrence of Rayleigh explosion, an effect that causes droplets essentially to explode during their flight due to the densification of charge in the course of vaporization-induced volume losses.

During printing it can be important that the substrate is properly immobilized and does not physically move. Such movement might otherwise cause improper alignment of printed structures and thereby reduce the accuracy of the print. Preferably, the substrate is immobilized on the acceleration electrode by means of vacuum clamping, and the acceleration electrode is preferably immobilized on an acceleration electrode holder. The acceleration electrode can be thoroughly made of a conductive material but it may also consist partly of non-conductive materials, for example the conductive part can be embedded as a layer in between two non-conductive sheets such as to reduce the likelihood of electrical breakdowns between acceleration electrode and print head. In any case, it is preferable that the conductive part of the acceleration electrode laterally covers the whole extent of the acceleration electrode. Holes for vacuum clamping of the substrate can be drilled into the acceleration electrode, wherein the holes preferably have a diameter between 10 μm and 1 mm, more preferably between 50 μm and 0.5 mm, wherein finer holes have the advantage of creating less electric field inhomogeneity above the substrate.

Such thin holes may be formed by mechanical or by laser drilling or by other methods known to those skilled in the art. A pumping unit that is preferably adapted to evacuate the holes can be attached to the acceleration electrode.

The print head may be attached to a print head holder which is adapted to tip and/or tilt the print head. The print head and the substrate can be in thermal contact with a heating and/or cooling source. One or more sensors can be arranged on the print head, and a control unit, being adapted to measure and control the distance between the substrate and the print head and to measure and control the temperature of the print head, can be attached to the print head holder.

The acceleration electrode can be tightly fixed on a heavy acceleration electrode holder that is optimized for vibrational damping. For example, said heavy acceleration electrode holder may consist of marble or the like that provides good damping of low frequency vibrations. In addition, the heavy acceleration electrode holder may be supplemented by a second damping system, such as a pneumatic damping system that essentially damps higher frequency vibrations. The heavy acceleration electrode holder may be movable in at least one lateral dimension, preferably it can perform arbitrary two-dimensional movements, such as to allow the quick placement of a substrate underneath the print head. Temperature sensors can be integrated into the acceleration electrode holder and be attached to a control unit that is adapted to measure and control the temperature of the acceleration electrode holder. The temperature sensors contained in the acceleration electrode holder provide information about the approximate temperature of the substrate surface that faces the print head.

The print head holder can serve as a rigid mechanical support to the print head. The holder is preferably made of aluminum or an aluminum alloy to reduce inertial mass, while offering a high thermal conductivity and maintaining good stiffness. The clamping of the print head to the holder may be achieved by an electrostatic chuck, or more preferably by a vacuum chuck. In case of a vacuum chuck, evenly distributed channels establish the clamping force needed to hold the print head in place, while additionally correcting bow present on the print head that potentially arises during microfabrication due to internal stresses. The preferred flatness of the holder and consequently of the print head after clamping and optimal orientation (i.e. by tip-tilt correction) allows the print head to be separated from the substrate at a preferred average distance without the creation of partial contacts between print head and substrate. A preferred average distance does not vary by more than 20%, more preferably an average distance does vary by less than 5%. For example, if a print head is intended to be separated from a substrate by 500 μm, its actual separation over the whole print head area should preferably be better than 500 μm±25 lam. In addition to the clamping mechanism, the print head holder preferably provides an interface to the liquid supply system and the electronic driving system and can serve as a cold and/or hot plate to control the print head temperature. When using through-silicon vias to route the electrical signals through the print head, spring-loaded tips may be embedded into the print head holder according to the print head layout. Low forces might be crucial in order to prevent print head deformation. Leak-tight fluidic connections to the print-head can be achieved by spring-loaded PTFE seals, whereas sealing is preferably performed in axial direction.

In general, the ejected liquid droplets can be considerably smaller than the nozzles they originate from. In order to prevent the accumulation of liquid, preferably only one droplet is deposited on the substrate at a time. However, this means that the liquid area that is exposed to the air is on average larger at the convex meniscus than at the deposited droplet. Consequently, one will generally face higher volumetric liquid flows by the evaporation of the convex meniscus than by the droplet ejection. In the course of printing, this can result in a concentration of solid material comprised in the ejected droplets that can be higher than the concentration in the stock solution that is supplied to the one or more liquid supply reservoir or the additional liquid supply reservoirs, respectively.

In case the amount of said concentration thickening eventually results in an equilibrated final concentration it can be accounted for, but there may still be differences in concentrations between different nozzles. A more severe consequence, however, can be concentration thickening during idle times. This can cause rapid clogging or the ejection of highly concentrated droplets during the first cycles of ejection, in case the nozzles were idle for a certain time.

In order to prevent such a concentration thickening, and thus clogging, or the ejection of highly concentrated droplets, both the print head and the substrate can be brought into good thermal contact with the heat and/or cooling source. Such a heat and/or cooling source can be made of a Peltier element or another embodiment known to those skilled in the art. Such a heat and/or cooling source is preferably integrated with the acceleration electrode holder and the print head holder, respectively. The cooling and/or heating action is preferably chosen such that the surfaces of print head and of the substrate facing each other differ in temperature by a required amount, wherein the higher temperature is preferably applied to the substrate. In particular, the temperature difference may be adjusted between 0-100° C., preferably it is adjusted between 0-50° C., more preferably between 0-20° C. Additionally, any separate absolute temperature is preferably chosen above the temperature at which freezing takes place. Furthermore, the absolute temperature at the print head is preferably chosen such that the liquid does not start boiling. Depending on the liquid used and on further preferences, the temperatures may be adjusted in absolute values. For example, the substrate surface may be at 20° C. and the print head surface at 10° C., or the substrate surface may be at 50° C. and the print head surface at 40° C. In both examples, the temperature difference is 10° C. but the absolute temperatures are different. Finally, absolute temperatures as well as temperature differences are preferably chosen such that there is no liquid accumulation on the substrate or the print head, respectively, due to condensation.

The print head and the print head holder can be mounted on a control unit that comprises or consists of a nanopositioner, a mircopositioner or a combination of both. A nanopositioning system can here be understood as a system which provides a high positional accuracy, smooth movements, but a limited driving range. A micropositioning system can here be understood as a system which provides lower positional accuracy, less smooth movements but a higher driving range. If the control unit is made as a combination of both micropositioner(s) and nanopositioner (s), the latter will commonly be employed for moving the print head relative to the substrate in the course of printing while the former can have its main purpose in performing initial alignments between the print head and the substrate, but is preferably not being used for performing movements during printing. The nanopositioning system preferably is stiff such as to bear the high inertial forces that can result from fast accelerations, scanning velocities and decelerations. Preferably, a piezo-driven system with flexure guiding system is used. The micropositioner may be actuated by stepper motors, linear motors, DC motors or the like. The control unit can provide at least 3 degrees of freedom (DOF) for translation in x, y and z direction. Preferably, it can provide 5 DOF for additional tip and tilt corrections, more preferably it can provide 6 DOF for additional rotational corrections. If the control unit is a combination of nanopositioner and micropositioner, some of these DOF may be fulfilled by one of said devices only or they may be performed by both of them. The control unit may contain an aperture for the feed through of the one or more liquid supply systems, the one or more additional liquid supply systems and electrical connections, respectively.

The distance and position control of the print head relative to the substrate can be measured by sensors, in particular by capacitive fringing field sensors, which can be arranged on the print head. Capacitive sensors are preferably formed at least at three different positions in the lower region of the print head surface, i.e., on that side of the print head that is facing the substrate, such as to provide the possibility for measuring the three-dimensional orientation of the print head surface with respect to the substrate. The sensors preferably are placed on remote edges of the print head in order to maximize the signal differences. The readout of the sensors can be achieved by accurate capacitance to digital (CDC) converters using the Sigma-Delta principle or by using a synchronous demodulator. On the basis of the measured distances, the control unit may be used in order to accurately position the print head with respect to the substrate, wherein accurate positioning means that the print head has the same separation from the substrate at every position of the lower region of its surface, with a maximal variation of preferably less than 50 μm, more preferably less than 10 μm, however exempt any inherent variations of the print head and substrate surfaces such as bow or the like.

The volumetric rate of fluid ejection can simply be controlled by adjustments of the electrical voltage applied between the extraction electrodes and the liquid that is contained in the nozzles. However, the mass flow rate of liquid ejection is generally not a monotonic function of the applied electric potential. Depending on the absolute voltage applied, a further increase of said absolute voltage may either result in higher or lower mass flow rate, at least if the nozzles are operated in the nanodripping mode. In some cases, however, the ejection flow rate may be too low or too high at the applicable range of voltages. For example, a liquid may be operated not in the nanodripping mode but in the so-called cone-jet mode which results in much higher mass flow rates than the former mode. The cone-jet mode is not the preferred mode of NanoDrip printing operation and it should therefore be attempted to reduce the mass flow rate until the nanodripping mode is obtained. If voltage adjustments do not lead to the attempted mode change, this may be achieved by globally adapting the pressure of the liquid inside the liquid supply reservoirs. For example, if a liquid is ejected in the cone-jet mode instead of the nanodripping mode during the whole range of voltages, one may attempt to induce a change towards the nanodripping mode by applying a negative pressure, i.e., a pressure that is lower than the environmental pressure, to the liquid that is contained inside the liquid supply reservoirs.

In particular, a fluid supply unit can be attached to the one or more liquid supply reservoirs and/or to the one or more liquid supply channels by leak-tight fluidic connections and is adapted to reduce or increase the pressure in the one or more liquid supply reservoirs and in the liquid supply channels.

Variable pressures can thus be applied by commercial feedback-controlled systems that supply air at variable pressure state. Alternatively, such a system may directly control the mass flow rate instead of the pressure, for example by using a syringe pump.

Figure 12:
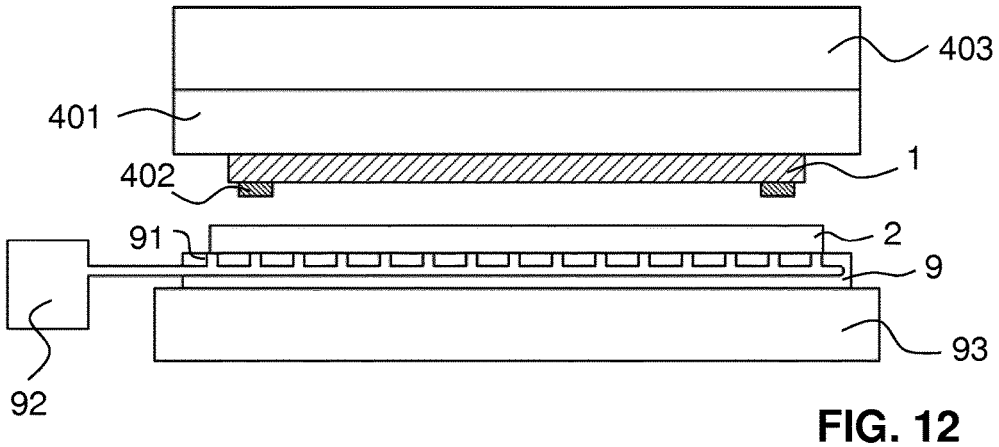
FIG. 12 shows a schematic sketch of an electrohydrodynamic print head system.

In the following, preferred embodiments are presented:

FIG. 1 shows a sectional drawing of a print head (1) for depositing liquid (42) from a liquid supply reservoir (41) onto a substrate (2) (see FIG. 12). In this first embodiment, the print head (1) comprises a layer structure including a stop layer (5), a device layer (6) and a first insulator layer (7). A first extraction electrode (8) is arranged on the first insulator layer (7). A first nozzle (3) is formed in the layer structure, and a ring trench (31) is formed in the device layer (6). An ejection channel (37) formed in the first insulator layer (7) releases the nozzle (3) towards the substrate (2). The first nozzle (3) has a nozzle opening (34) that extends through the layer structure. The ring trench (31) is radially delimited by an outer ring trench wall (35) and an inner ring trench wall (36). The nozzle opening (34) and the ring trench (31) are separated by an annular nozzle wall (32), which defines a distal end surface (33) that faces the substrate (2). The inner ring trench wall (36) thereby corresponds to a surface which conforms to the outer surface of the annular nozzle wall (32). Due to the formation of the ejection channel (37) the annular nozzle wall (32) at its distal end surface (33) is free of the first insulator layer (7). An idle liquid meniscus (44) is formed at the nozzle opening (34) at the inner annular nozzle wall (32) surface, preferably by a capillary action driving the liquid (42) from the liquid supply reservoir (41) along the inner nozzles wall (32) towards the nozzle opening (34). Prior to the ejection of the liquid (42) in the form of a droplet (43) through the nozzle opening (34), a device potential relative to the liquid potential is applied to the device layer (6) that can form a convex meniscus (45) of a liquid surface in the region of the nozzle opening (34). An acceleration electrode (9) is placed below the substrate (2) and accelerates the ejected droplet (43) towards the substrate (2) (see FIG. 12). The surface of the print head (1) is coated with a protective coating (301) which prevents electricity from breaking through the air and causing an electric breakdown. All surfaces of the print head (1) being in contact with the liquid are furthermore coated with a surface coating (300). In order to make good contact to the liquid (42), the surface of the liquid supply reservoir (41) may be coated with an electrically conducting material that is preferably chemically inert, more preferably it is a material being gold or platinum (not shown). For example, such an electrically conductive coating can be deposited onto the sidewalls of the liquid supply reservoir (41) and extends into the tubular surface of the interior of the nozzle (3). Preferably, such an electrically conductive coating partially or fully coats the inner surface of the nozzle wall.

Figure 2:
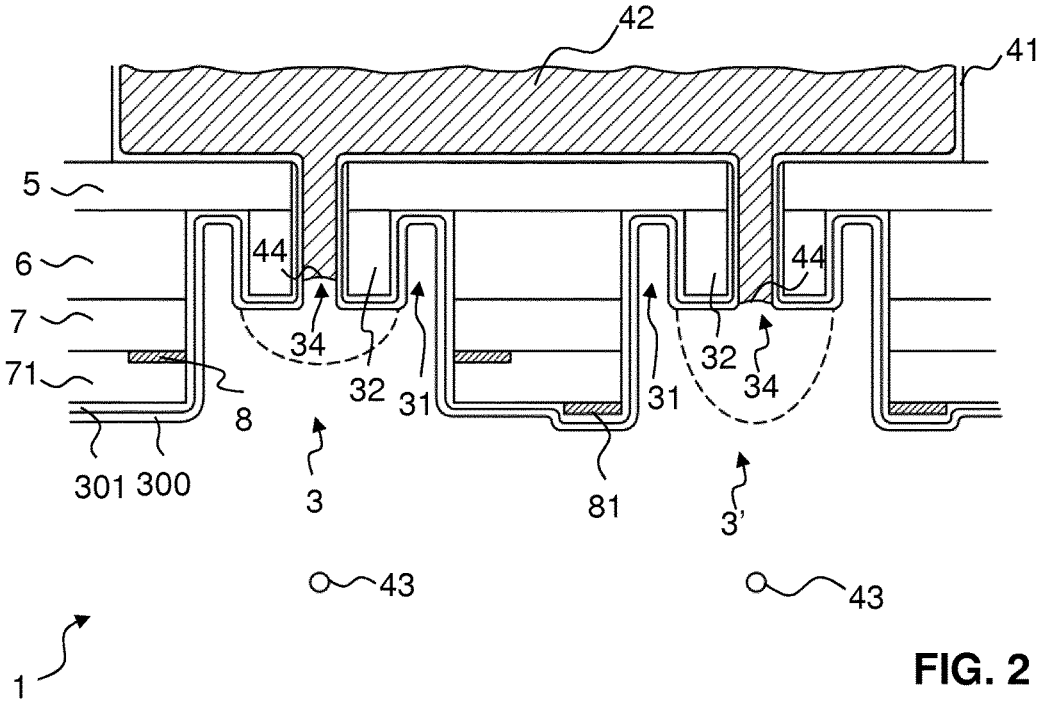
FIG. 2 shows a sectional drawing of the print head comprising the first nozzle and a further nozzle according to a second embodiment.

FIG. 2 shows a sectional drawing of a print head (1) according to a second embodiment, where a further nozzle (3') is formed in the layer structure. The layer structure includes a further insulator layer (71) which is arranged on the first insulator layer (7). A further extraction electrode (81) is arranged on the further insulator layer (71). In this particular example, the adjacent first nozzle (3) has a smaller diameter than the further nozzle (3'). The first extraction electrode (8) is arranged on the first insulator layer (7) and covered by the further insulator layer (71) and surrounds the first nozzle (3). Applying an extraction potential to the first extraction electrode (8) only results in the ejection of droplets (43) from the first nozzle (3) while applying an extraction potential to the further extraction electrode (81) only results in the ejection of droplets (43) from the further nozzle (3'), as long as the extraction potential of any extraction electrode is above the minimal ejection voltage, respectively.

Figure 3:
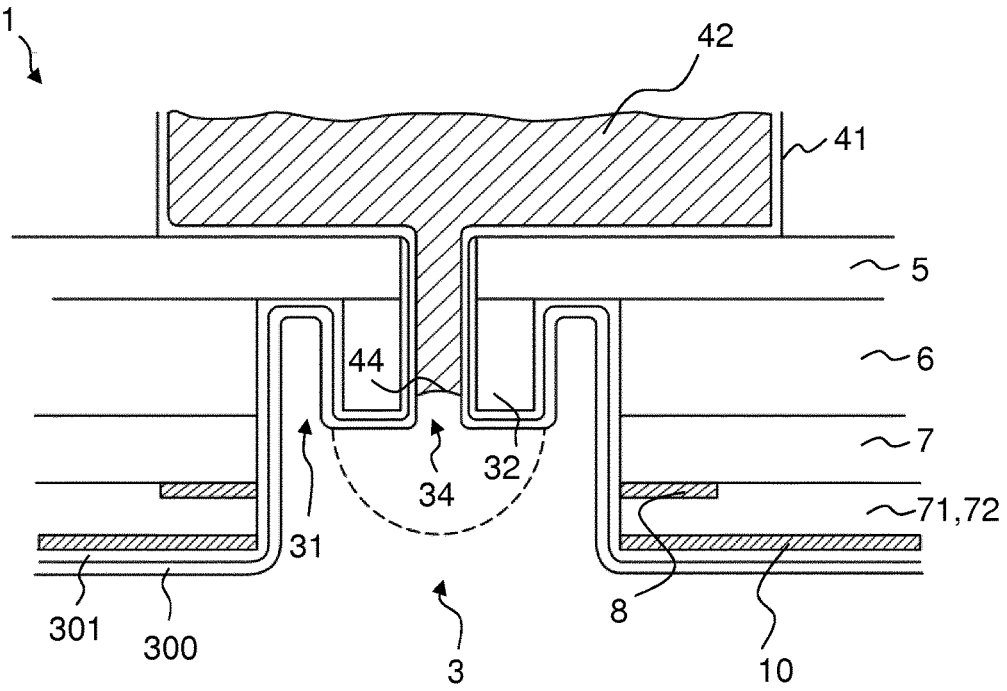
FIG. 3 shows a sectional drawing of the print head further comprising a shielding layer according to a third embodiment.

FIG. 3 shows a sectional drawing of a print head (1) according to a third embodiment, wherein a shielding layer (10) is arranged on a terminal insulator layer (72). The shielding layer (10) extends over the first extraction electrode (8) and has a shielding opening that is centered above the nozzle opening (34).

Figure 4:
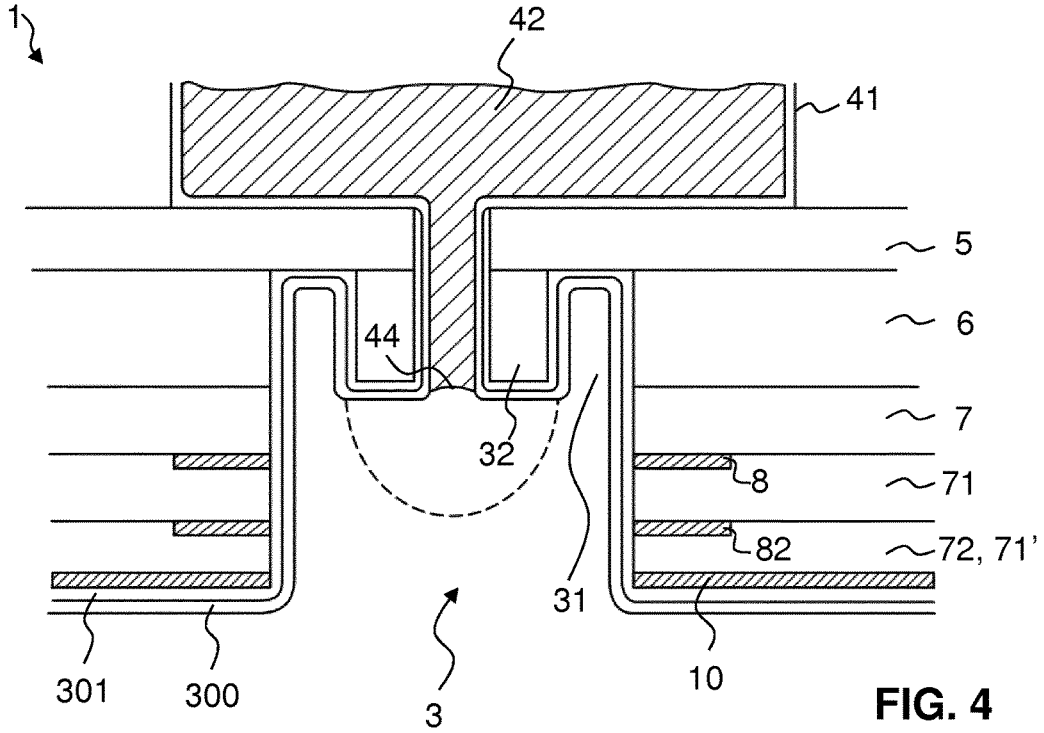
FIG. 4 shows a sectional drawing of the print head further comprising a terminal insulator layer according to a fourth embodiment.

FIG. 4 shows a sectional drawing of a print head (1) according to a fourth embodiment, wherein the layer structure comprises a terminal insulator layer (72) that is arranged on the further insulator layer (71). A homogenization extraction electrode (82) is arranged on the further insulator layer (71) and covered by the terminal insulator layer (72) and surrounds the first nozzle (3). The first extraction electrode (8) is arranged on the first insulator layer (7), and the shielding layer (10) is arranged on the terminal insulator layer (72).

Figure 5:
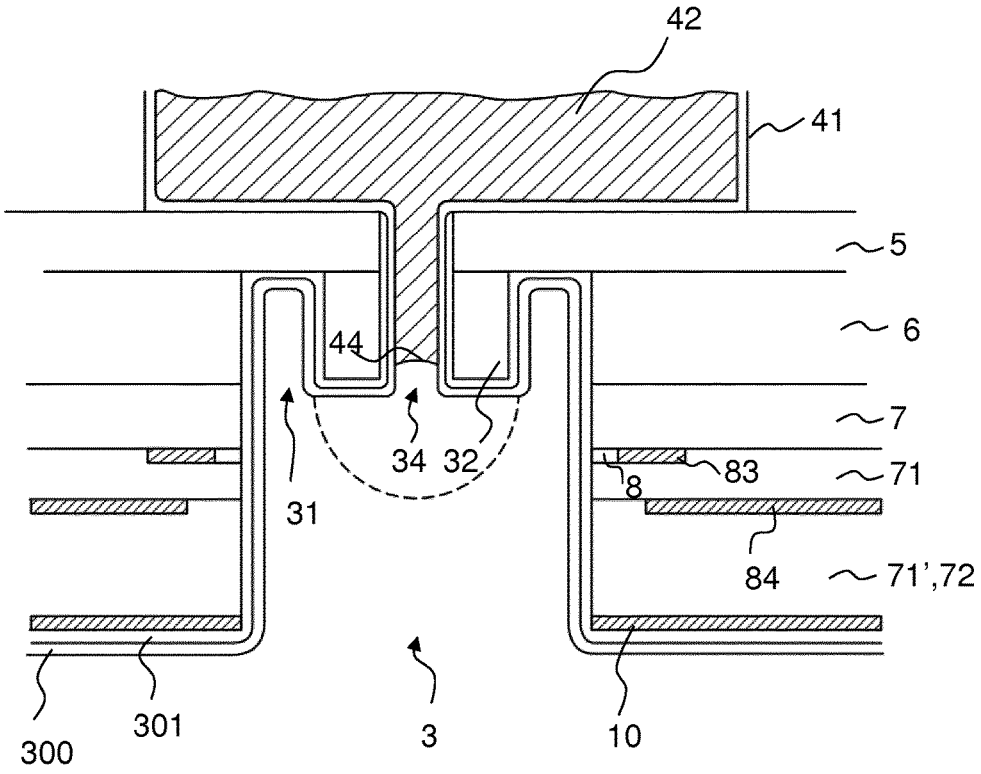
FIG. 5 shows a sectional drawing of the print head having a first extraction electrode extended by an electrode extension and with a conductive path according to a fifth embodiment.

FIG. 5 shows a sectional drawing of a print head (1) according to a fifth embodiment, wherein the first extraction electrode (8) is extended by an electrode extension (83) and wherein a conductive path (84) supplying a voltage signal is arranged on the further insulator layer (71) and capacitively contacts the electrically floating extraction electrode (8) via capacitive coupling with the electrode extension (83). In addition, a shielding layer (10) is arranged on the terminal insulator layer (72).

Figure 6:
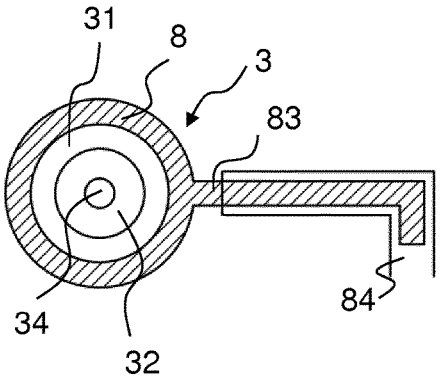
FIG. 6 shows a top view of the electrode extension and of the conductive path, the electrode extension and the conductive path being coupled capacitively.

FIG. 6 shows a top view of the electrode extension (83) of the first extraction electrode (8) as used in the embodiment shown in FIG. 5. In this example, the electrode extension corresponds to a straight line containing a 90° angle that allows it to pass, e.g. other nozzles (3, 3') or other extraction electrodes (8, 81) also comprised in the layer structure of the print head (1). The figure also displays the conductive path (84), which extends over the electrode extension (83).

Figure 7:
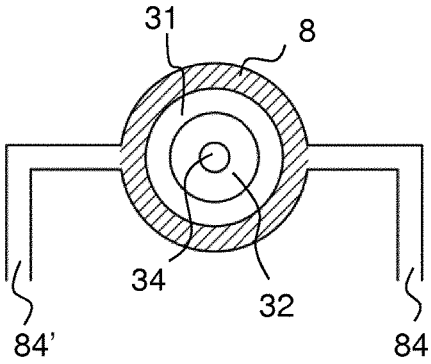
FIG. 7 shows a top view of an electrode extension and of two conductive paths being in direct contact with an extraction electrode.

FIG. 7 shows a top view of two voltage-supplying conductive paths (84, 84') being attached to an extraction electrode (8, 81) for electrically contacting said extraction electrode (8, 81). The two conductive paths (84, 84') are arranged opposite to one another. Here, the conductive paths (84, 84') are in direct contact with the extraction electrode (8, 81), whereas in FIGS. 5 and 6, the conductive path (84) is not attached to the extraction electrode but capacitively coupled to the electrode extension (83).

Figure 8:
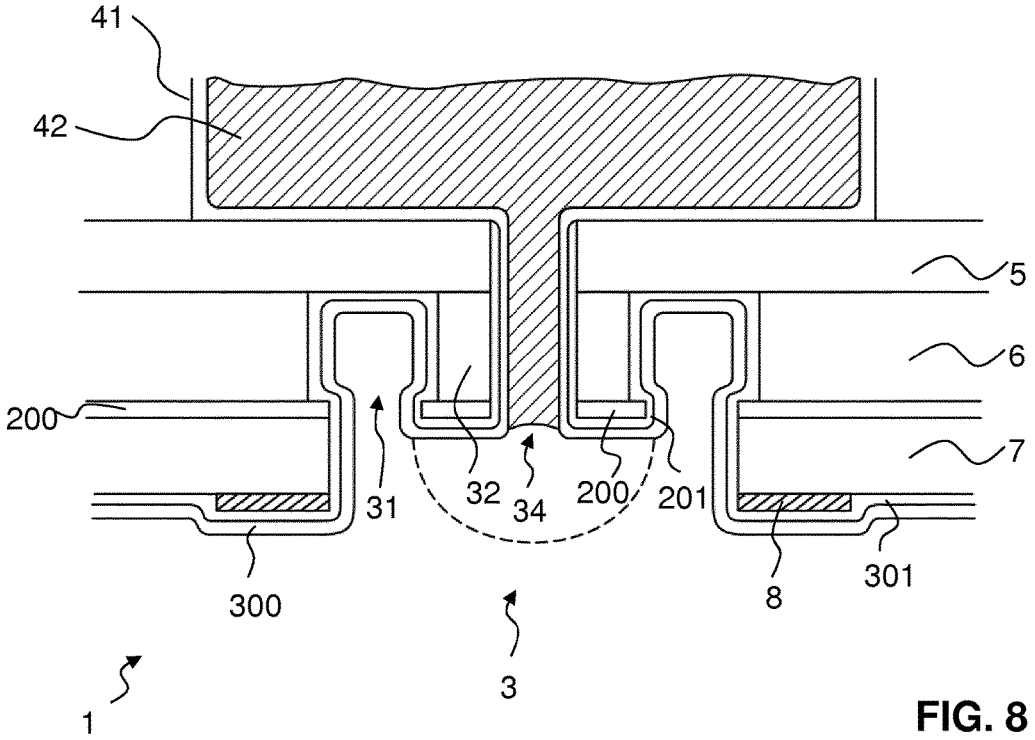
FIG. 8 shows a sectional drawing of the print head further comprising an etch-stop layer according to a sixth embodiment.

FIG. 8 shows a sectional drawing of a print head (1) according to a sixth embodiment, wherein the layer structure further comprises an etch-stop layer (200). The etch-stop layer (200) is arranged between the device layer (6) and the first insulator layer (7) and on the distal end surface (33) of the nozzle. A contact angle discontinuity (201) in the form of a sharp transition is formed in the etch-stop layer (200) by laterally under-etching the outer nozzle wall (32) surface beneath the etch-stop layer (200). The contact angle discontinuity (201) is used to circumvent wetting of the ring trench (31) by the liquid (42).

Figure 9:
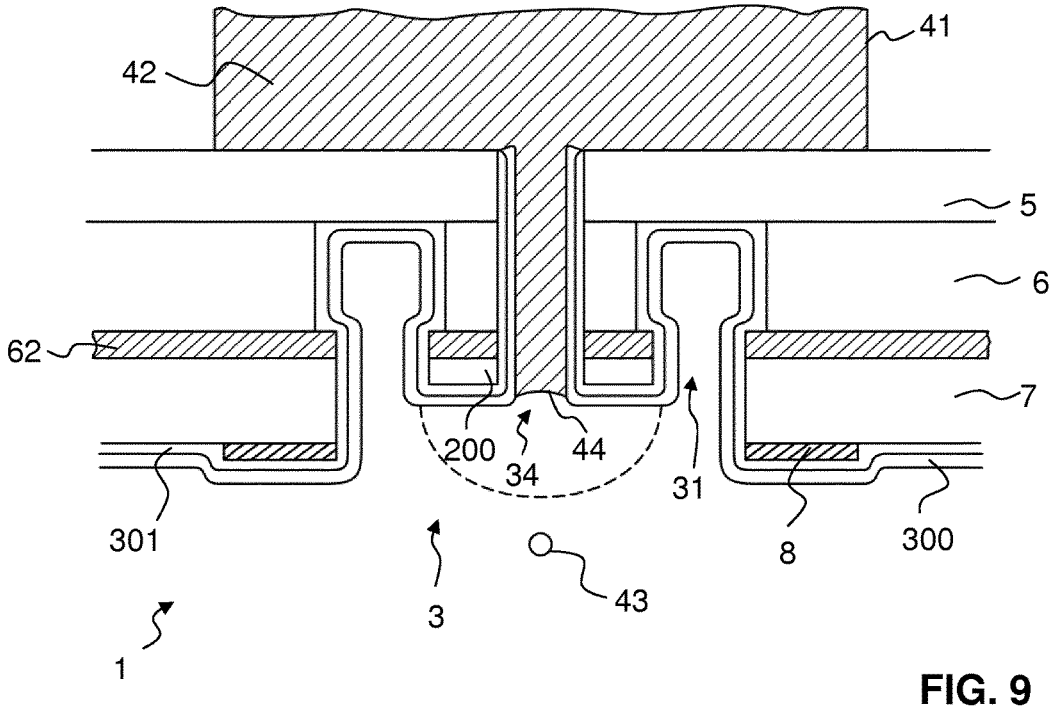
FIG. 9 shows a sectional drawing of the print head further comprising a device coating according to a seventh embodiment.

FIG. 9 shows a sectional drawing of a print head (1) according to an seventh embodiment, wherein the layer structure comprises an electrically conductive device coating (62) that is arranged between the device layer (6) and the first insulator layer (7), and that improves the distribution of an electric potential to the device layer (6) without voltage drops. The device coating (62) may also cover the distal end surface (33) of the nozzle. The device coating (62) may be combined with an etch-stop layer (201), in which case the device coating (62) should be deposited first, i.e. a device coating (62) may be arranged on the device layer (6) to provide good electrical contact and wherein the etch-stop layer (201) is arranged in between the device coating (62) and the first insulator layer (7) (not shown). The device coating (62) and the etch-stop layer (201) can be made of the same material that fulfills both the requirements of the device coating and the etch-stop layer, in which case they essentially merge into a single layer.

Figure 10:
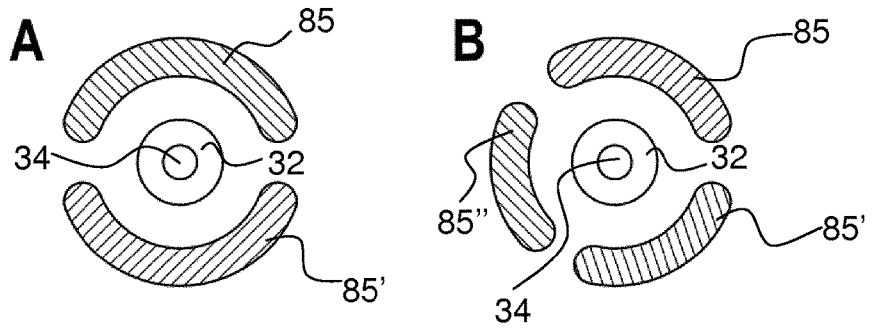
FIG. 10 shows a top view of an extraction electrode split into two segments and into three segments.

FIG. 10 shows a top view of an extraction electrode split into two segments (left side) and into three segments (right side), respectively. In particular, an annular extraction electrode (8, 81), i.e., a ring electrode, is split into two electrode segments (85, 85') and into three electrode segments (85, 85', 85") of equal semiannular shape, respectively, that are uniformly arranged and that enclose a lateral separation between their opposite ends, i.e., between ends of adjacent segment.

Figure 11:
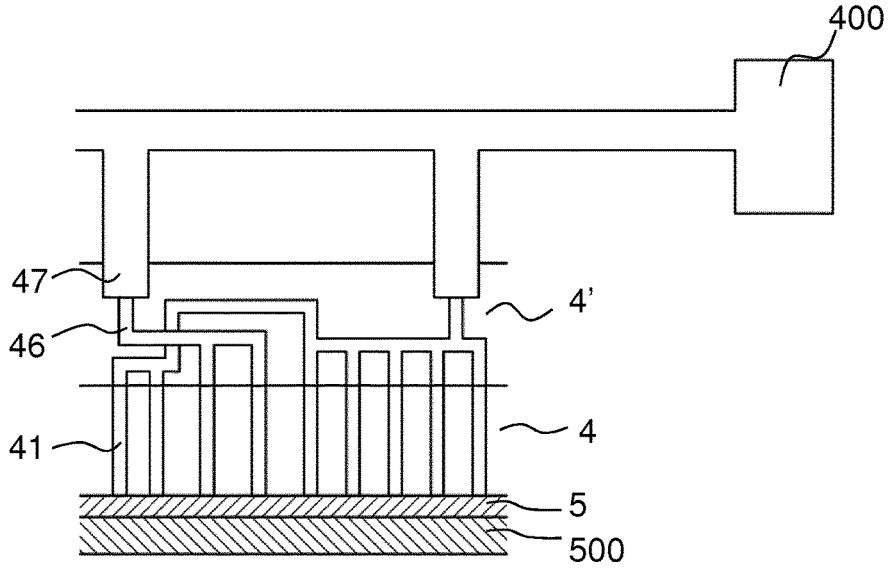
FIG. 11 shows a schematic sketch illustrating a cross section of the print head further comprising liquid supply layers forming liquid supply reservoirs and liquid supply channels, respectively.

FIG. 11 shows a schematic sketch illustrating cross sections through a print head (1), wherein two liquid supply layers (4, 4') are arranged above the stop layer (5). The liquid supply layer arranged adjacent to the stop layer (5) forms liquid supply reservoirs (41) that are in fluid communication with the nozzle openings (34) of nozzles (3, 3') formed in the layer structure of the print head (1) (not shown). The second liquid supply layer arranged on top of said liquid supply layer forms liquid supply channels (46) into which the liquid (42) is introduced via leak-tight fluidic connections (47) that connect the liquid supply channels to a fluid supply unit (400) that can adjust a volumetric rate associated with the ejection of the droplets (43) from the nozzle openings (34).

FIG. 12 shows a schematic sketch of an electrohydrodynamic print head system, wherein the substrate (2) is immobilized on the acceleration electrode (9) by means of vacuum clamping. Holes (91) are drilled into the acceleration electrode (9) that enable clamping of the substrate (2) on the acceleration electrode (9) when a pumping unit (92) is attached to the acceleration electrode (9) and used to evacuate the holes (91). The acceleration electrode (9) is mechanically attached to an acceleration electrode holder (93) that provides vibrational damping and that can be heated or chilled, e.g. by a Peltier element. The print head (1) is attached to a print head holder (401). The print head (1) and the print head holder (401) are mounted on a positioning system (403) that is adapted for at least three degrees of freedom for translation in x, y, and z-direction, but preferably is also adapted for tip and/or tilt and/or for rotational movements. Sensors (402) arranged on the print head (1) measure the temperature of the print head and measure the distance between the substrate (2) and the print head (1) and can be connected to a control unit that uses the measured data for feedback-controlled adaption of the measured values of temperature and distance. A temperature sensor (not shown) may also be integrated into the acceleration electrode holder and be connected to a control unit such as to allow measurement and approximate control of the substrate temperature via heat control of the acceleration electrode holder.

Although the figures show distinct embodiments of the print head with a particular arrangement and number of extraction electrodes, layers, etc., numerous other configurations are possible where a particular print head comprises any desired combination of the above features.

The invention claimed is:

1. A print head for depositing a liquid on a substrate, the print head comprising a layer structure including, in this sequence along a direction of ejection, the following layers:

a stop layer made of a dielectric material;

a device layer deposited on the stop layer;

a first insulator layer being made of a dielectric material and being deposited on the device layer;

wherein at least one first nozzle is formed in the layer structure, the first nozzle having a nozzle opening for ejecting the liquid, said nozzle opening extending through the layer structure, wherein a ring trench is formed in the device layer, said ring trench radially surrounding the first nozzle, wherein the nozzle opening and the ring trench are radially separated by an annular nozzle wall, said annular nozzle wall having a distal end surface, wherein an ejection channel is formed in the first insulator layer, said ejection channel being centered around the first nozzle and extending from the first insulator layer all the way to the distal end surface of the nozzle, and wherein a first extraction electrode is arranged on the first insulator layer and surrounds the first nozzle, the first extraction electrode being arranged after the first insulator layer with respect to the direction of ejection.

2. The print head according to claim 1, wherein the annular nozzle wall has an outer circumferential surface defining a nozzle diameter, half of said nozzle diameter defining a nozzle radius, and wherein the ring trench has a width that is chosen between half the nozzle radius and ten times the nozzle radius.

3. The print head according to claim 2, wherein the ring trench has a width that is chosen between one time the nozzle radius and four times the nozzle radius.

4. The print head according to claim 1, wherein the first extraction electrode has an annular portion that radially surrounds the ejection channel.

5. The print head according to claim 4, wherein the annular portion of the first extraction electrode defines an electrode width, said electrode width being between half the nozzle radius and ten times the nozzle radius of the first nozzle.

6. The print head according to claim 5, wherein at least one conductive path is attached to the first extraction electrode for electrically contacting said first extraction electrode.

7. The print head according to claim 6, wherein at least one of: a) the conductive path has a width that is smaller than the electrode width of the first extraction electrode, at least in proximity to the first extraction electrode; and b) opposite to the at least one conductive path, another conductive path is attached to said first extraction electrode in order to create symmetry in the electric fields created at the nozzle.

8. The print head according to claim 5, wherein at least one of the first extraction electrode and the further extraction electrode and the homogenization electrode is extended by an electrode extension, and wherein a conductive path supplying a voltage signal is arranged on the further insulator layer that is deposited onto the electrode extension, the conductive path being capacitively coupled to the electrode extension.

9. The print head according to claim 8, wherein at least one of: a) the electrode extension is formed as a straight line; b) the electrode extension has a width that is equal to or smaller than the electrode width of at least one of said first extraction electrode and said further extraction electrode and said homogenization electrode; c) the conductive path has a radial distance from the nozzle opening that is larger than the distance from the outer circumference of the annular portion of at least one of the first extraction electrode and further extraction electrode and said homogenization electrode to said nozzle opening; and d) the width of the at least one conductive path is wider than the width of the electrode extension, so as to improve capacitive coupling between the electrode extension and the conductive path.

10. The print head according to claim 5, wherein the electrode width is between one times of said nozzle radius and four times of said nozzle radius.

11. The print head according to claim 1, wherein at least one further nozzle in formed in the layer structure.

12. The print head according to claim 11, wherein the further nozzle has a larger diameter than the first nozzle.

13. The print head according to claim 11, wherein the layer structure includes at least one further insulator layer, said at least one further insulator layer being arranged on the first insulator layer along the direction of ejection, wherein said at least one further insulator layer forms an opening at the position of at least one of the at least one first nozzle and the at least one further nozzle, the opening extending the ejection channel.

14. The print head according to claim 13, further comprising a further extraction electrode, said further extraction electrode being arranged on the further insulator layer or on the first insulator layer, wherein the further extraction electrode surrounds the further nozzle.

15. The print head according to claim 13, wherein at least one homogenization electrode is arranged on at least one of the further insulator layers, said at least one further insulator layer being arranged on the first extraction electrode or on the further extraction electrode along the direction of ejection, and wherein said at least one homogenization electrode surrounds at least one of the first nozzle and the further nozzle, respectively, as a ring electrode having an inner diameter that is equal to or larger than the diameter of the ejection channel.

16. The print head according to claim 15, wherein the ring electrode has an inner diameter that is equal to or larger than the inner diameter of the first extraction electrode or the further extraction electrode, respectively.

17. The print head according to claim 1, wherein the layer structure includes a terminal insulator layer, said terminal insulator layer being arranged either on the first insulator layer or on that further insulator layer that is arranged at a furthest distance from the stop layer along the direction of ejection, wherein said terminal insulator layer forms an opening that extends the ejection channels along the direction of ejection, and wherein a shielding layer is arranged on the terminal insulator layer, the shielding layer being electrically conductive, wherein the shielding layer has circular openings that surround the ejection channels but that are smaller in diameter than the outer diameter of the respective annular portions of at least one of the first extraction electrodes and the further extraction electrodes, and wherein the shielding layer radially extends at least beyond at least one of the first extraction electrodes and the further extraction electrodes.

18. The print head according to claim 17, wherein the shielding layer is formed as a continuous layer.

19. The print head according to claim 1, further comprising an etch-stop layer arranged on at least one of the distal end surface of the first nozzle and the further nozzle, said etch-stop layer comprising an etch-resistant material, or a device coating arranged between the device layer and the first insulator layer, said device coating comprising a conductive material, wherein a contact angle discontinuity in the form of a sharp transition is formed in the etch-stop layer or in the device coating in the region of the ring trenches to circumvent wetting of the ring trench by the liquid.

20. The print head according to claim 19, wherein at least one of the etch-stop layer is arranged also between the device layer and the first insulator layer, and the etch-resistant material is a dielectric material, and the conductive material of the device coating is a metal.

21. The print head according to claim 1, wherein the first extraction electrode is split into at least two portions.

22. The print head according to claim 21, wherein the first extraction electrode is split into at least three portions.

23. The print head according to claim 1, further comprising at least one liquid supply layer arranged below the stop layer, said at least one liquid supply layer forming at least one of one or more liquid supply reservoirs and one or more liquid supply channels being in fluid communication with the nozzle opening.

24. The print head according to claim 1, wherein at least one of at least part of the surface of the print head is coated with a protective coating, the protective coating being made of a dielectric material and preventing a dielectric breakdown through a surrounding gaseous environment, and at least part of the surface of the print head is coated with a surface coating, the surface coating being liquid-repellent.

25. The print head according to claim 24, wherein at least one of: a) the print head is at least coated on all surfaces beyond the nozzle opening on the side of the print head that faces the substrate; and b) the surface coating comprises at least one of a polymeric and organic material.

26. The print head according to claim 24, wherein the surface coating comprises polytetrafluoroethylene.

27. An electrohydrodynamic printing system comprising a print head according to claim 1 and an acceleration electrode, said acceleration electrode being spaced from the print head along the direction of ejection.

28. A method of electrohydrodynamic printing of a liquid onto a substrate using the electrohydrodynamic printing system according to claim 27, the method comprising, in arbitrary order:

i) supplying the liquid to the nozzle opening;

ii) optionally applying a device potential to the device layer for at least one of shaping the electric field at the nozzle and for forming a convex meniscus of a liquid surface in the region of the nozzle opening, the device potential relative to a potential of the liquid being zero or lower than a minimal voltage necessary for ejection of a droplet;

iii) applying an extraction potential to at least one of the extraction electrodes, the applied extraction potential relative to the potential of the liquid being equal to or above the minimal voltage necessary for ejection of a droplet from said convex meniscus;

iv) optionally applying a homogenization potential to the homogenization electrode such that the ejected droplet experiences less lateral deflection in the ejection channel;

v) optionally applying a shielding potential to the shielding electrode such that the ejected droplet experiences less lateral deflection in the ejection channel and in the region outside of the ejection channel; and vi) applying an acceleration potential to the acceleration electrode such that the ejected droplet is accelerated towards the substrate, wherein one or more of the preceding steps can be carried out simultaneously.

29. The method according to claim 28, wherein at least one of the applied device potential relative to the potential of the liquid has a different polarity than the applied extraction potential relative to the potential of the supplied liquid during the ejection of a droplet, and the shielding potential applied to the shielding layer, relative to the liquid potential has a smaller amplitude than the extraction potential applied to the extraction electrodes, relative to the liquid potential, and wherein the homogenization potential applied to the homogenization electrode, relative to the liquid potential has a smaller amplitude than the extraction potential applied to the extraction electrodes, relative to the liquid potential, during the ejection of a droplet, and a volumetric rate associated with the ejection of the droplet is adjusted by a fluid supply unit.

30. The method according to claim 28, wherein in step i) the supplied liquid is at electrical ground.

31. The print head according to claim 1, wherein at least one of: a) the device layer is electrically conducting; and b) the ring trench extends from the device layer all the way to the stop layer.

* * * * *